United States Patent [19]

Takahashi

[11] 4,282,401

[45] Aug. 4, 1981

[54] SYSTEM FOR TRANSMISSION AND RECEPTION OF DISCRETE FOUR CHANNEL STEREO

[75] Inventor: Susumu Takahashi, Tokyo, Japan

[73] Assignee: Sansui Electric Company, Tokyo, Japan

[21] Appl. No.: 210,866

[22] Filed: Dec. 22, 1971

[30] Foreign Application Priority Data

| | | | |
|---|---|---|---|
| Dec. 24, 1970 | [JP] | Japan | 45-117258 |
| Dec. 30, 1970 | [JP] | Japan | 45-122306 |
| Apr. 27, 1971 | [JP] | Japan | 46-27836 |
| Apr. 27, 1971 | [JP] | Japan | 46-27838 |
| Jun. 2, 1971 | [JP] | Japan | 46-37888 |
| Jun. 9, 1971 | [JP] | Japan | 46-40185 |
| Jul. 15, 1971 | [JP] | Japan | 46-52597 |
| Aug. 12, 1971 | [JP] | Japan | 46-61252 |

[51] Int. Cl.[3] ..... H04H 5/00

[52] U.S. Cl. ..... 179/1 GH; 179/1 GM; 179/1 GD

[58] Field of Search ..... 179/15 BT, 1 GH, 1 GQ, 179/100.4 ST, 100.1 TD, 1 GM

[56] References Cited

U.S. PATENT DOCUMENTS

| | | | |
|---|---|---|---|
| 3,573,382 | 4/1971 | Feit | 179/15 BT |
| 3,679,832 | 7/1972 | Halpern | 179/15 BT |
| 3,708,623 | 1/1973 | Dorren | 179/15 BT |

OTHER PUBLICATIONS

The Quart Broadcasting System, by Geryon, Audio Magazine, Sep. 1970.

Quadrasonics on the Air, Feldman, Audio Magazine, Jan. 1970.

*Primary Examiner*—Douglas W. Olms

*Attorney, Agent, or Firm*—Frishauf, Holtz, Goodman and Woodward

[57] ABSTRACT

A system for transmission and reception of discrete four channel stereo for utilizing a carrier frequency modulated in accordance with a modulation function of the form:

$$f_1(t) = A + B\sin 2\omega t + C\cos 2\omega t + D\sin 4\omega t + K\sin\omega t$$

where $A = LF + LR + RR + RF,$ $B = LF + LR - RR - RF,$ $C = LF - LR = RR + RF,$ $D = LF - LR + RR - RF,$ LF, LR, RR and RF are audio signals, K is a constant and $\omega$ is an angular frequency higher than that of the audio signals.

26 Claims, 37 Drawing Figures

MATRIX
59
LF
LR
RR
RF
60
61
62
63
A
B
C
D
64
65
66
67
BALANCED MODULATOR
68
38KHz
0°
BALANCED MODULATOR
69
38KHz
90°
BALANCED MODULATOR
70
76KHz
ADDER
71
72
73
FREQUENCY MODULATOR
74
75
76
77
78
152KHz
79
80
81
82
83
J
K
Q
Q̄
T
F/F

+
-
T

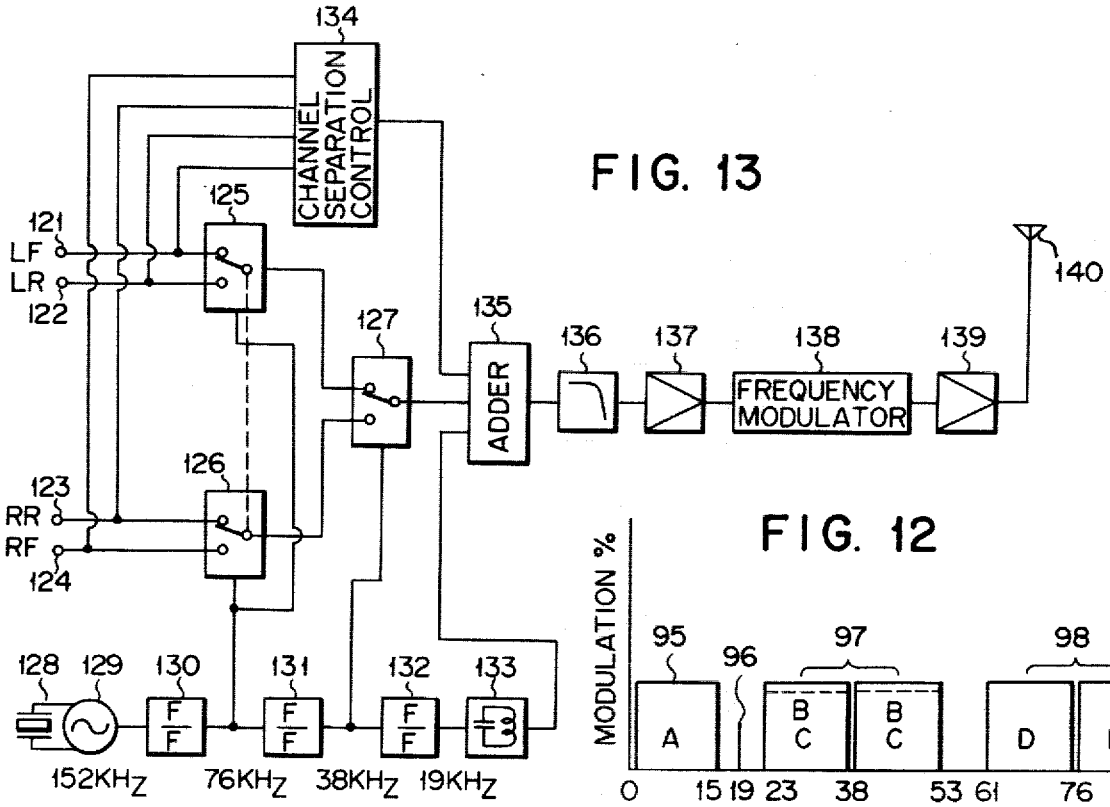
FIG. 13
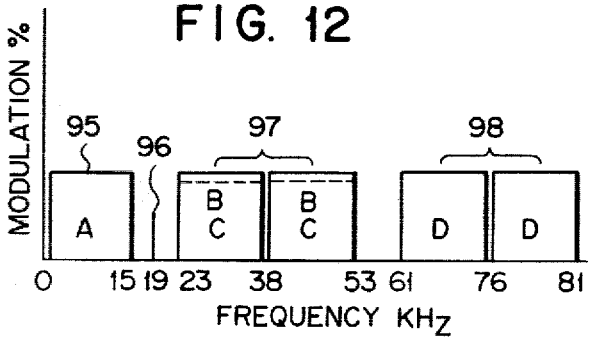
FIG. 12
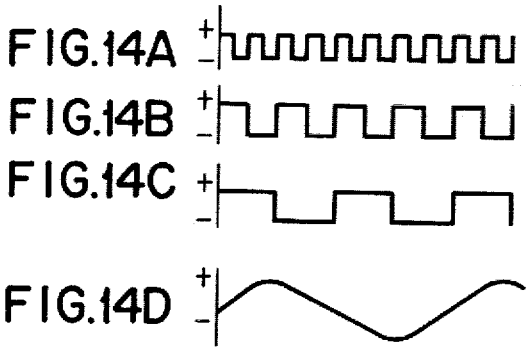
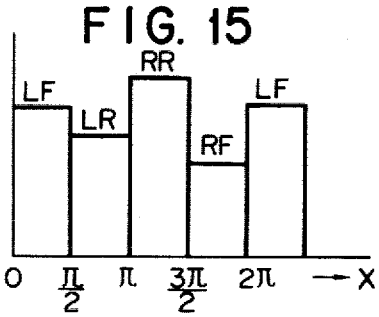
FIG. 15
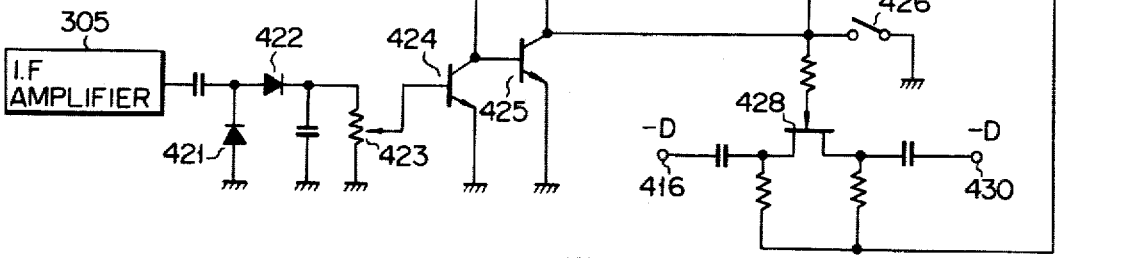
FIG. 20

134
B+
LF
121
LR
122
RR
123
RF
124
281
282
283
284
285
286
287
288
289
290
127
250
251
252
253
254
255
256
257
258
240
241
242
243
38KHZ
244
245
246
136
113
135
260
261
262
271
272
273
274
275
276
277
COMPOSIT SIGNAL OUTPUT

SYSTEM FOR TRANSMISSION AND RECEPTION OF DISCRETE FOUR CHANNEL STEREO

BACKGROUND OF THE INVENTION

The invention relates to system for transmission and reception of discrete four channel stereo.

Discrete four channel stereophonic broadcasting systems comprise a transmitter to which are fed discrete four signals, that is, a signal representing a Left Front (or "LF") channel, a signal representing a Left Rear.(or "LR") channel, a signal representing a Right Front (or "RF") channel and a signal representing a Right Rear (or "RR") channel, and the transmitter encodes these LF, LR, RF and RR signals into four suitable electrical signals for transmition to one or more receivers of the system. The receivers decode the received signals into LF, LR, RF and RR electrical signals which are respectively fed to suitably placed LF, LR, RF and RR loudspeakers for recreating LF, LR, RF and RR sound corresponding to the LF, LR, RF and RR signals that were fed to the transmitter. The LF, LR, RF and RR signals fed to the transmitter may be sound signals picked up by microphones, or signals recorded on a medium such as magnetic tape or phonograph discs.

SUMMARY OF THE INVENTION

An object of this invention is to provide an inexpensive multiplex broadcasting system for discrete four channel stereo having an improved signal-to-noise ratio and having an improved stability in which conventional receivers and tuners for the reception of monaural or two channel stereo can be adapted compatibly for receiving and utilizing descrete four channel signals thereof.

According to this invention, there is provided a discrete four channel stereophonic broadcasting system comprising a transmitter and at least one receiver, said transmitter having source of four-channel stereophonically rellated audio frequency signals representing LF, LT, RF and RR respectively, means for producing a composite signal representing a modulation function of the form:

$$f_1(t)=A+B\sin 2\omega t+C\cos 2\omega t+D\sin 4\omega t+K\sin \omega t$$

where $A=LF+LR+RR+RF$, $B=LF+LR-RR-RF$, $C=LF-LR-RR+RF$, $D=LF-LR+RR-RF$,

K is a constant, and $\omega$ is an angular frequency higher than that of said audio signals, means for providing a main carrier wave, means for frequency modulating said main carrier wave in accordance with said composite signal, and means for broadcasting said frequency modulated main carrier wave, said receiver comprising means for receiving and demodulating the frequency modulated main carrier wave to provide said composite signal, means for detecting said composite signal under the control of the pilot signal representing the function $K \sin \omega t$ defined as the fifth term of the aforementioned equation to provide said audio frequency signals representing LF, LR, RF and RR respectively.

BRIEF DESCRIPTION OF THE DRAWINGS

FIG. 12 is a graph illustrating a frequency spectrum of the output signal of the block 71 shown in FIG. 6, FIG. 13 is a block diagram illustrating another embodiment of a transmitter of the present invention, FIGS. 14A through 14D is a graph illustrating waveforms of various output signals in FIG. 13, FIG. 15 is a graph illustrating a waveform of the output signal of the block 135 in FIG. 13, FIGS. 16 and 17 are detailed circuit diagrams of the embodiment shown in FIG. 13, FIG. 20 is a detailed circuit diagram of the block 325 shown in FIG. 18.

DESCRIPTION OF THE PREFERRED EMBODIMENTS

Figure 1:
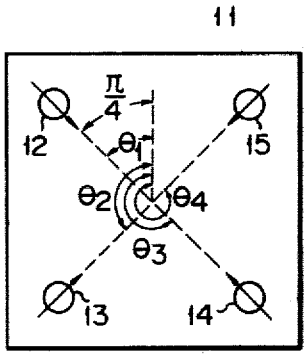
FIG. 1 shows an arrangement of four microphones for picking up audio signals used in a four-channel broadcasting system according to the present invention.

As shown in FIG. 1, at the transmitter station of the broadcasting system of the present invention, microphones 12, 13, 14 and 15 are arranged in substantially horizontal plane to pick up sounds of all directions in the sound field 11. As shown, the microphones 12, 13, 14 and 15 are arranged at the angles $\theta_1$, $\theta_2$, $\theta_3$ and $\theta_4$ from the front of the sound field, respectively. By the microphones 12, 13 14 and 15 thus positioned, a left front (LF) audio signal, a left rear (LR) audio signal, a right rear (RR) audio signal and a right front (RF) audio signal, which are in four-channel stereophonic relation to each other, are picked up. The four audio signals LF, LR, RR and RF are matrix-converted in a manner shown in the following formula to be encoded into four signals A, B, C and D.

$$\begin{bmatrix} A \\ B \\ C \\ D \end{bmatrix} = \begin{bmatrix} 1 & 1 & 1 & 1 \\ m\sin\theta_1 & m\sin\theta_2 & m\sin\theta_3 & m\sin\theta_4 \\ m\cos\theta_1 & m\cos\theta_2 & m\cos\theta_3 & m\cos\theta_4 \\ n\sin 2\theta_1 & n\sin 2\theta_2 & n\sin 2\theta_3 & n\sin 2\theta_4 \end{bmatrix} \begin{bmatrix} LF \\ LR \\ RR \\ RF \end{bmatrix} \quad (1)$$

Figure 2:
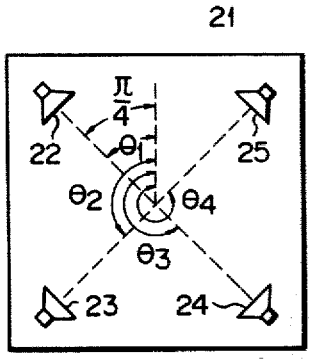
FIG. 2 shows an arrangement of four loud speakers for reproducing sound from four demodulated audio signals of the receiver in the four-channel broadcasting system according to the present invention.

At the receiving station of the broadcasting system of the present invention, four loud speakers 22, 23, 24 and 25 are arranged in a substantially horizontal plane to face inwardly in an area 21, as shown in FIG. 2. The loud speakers at the receiving station are arranged in the listening area 21 in the same way as the arrangement of the microphones in the sound field 11 at the transmitting station. Namely, the speakers 22, 23, 24 and 25 have the angles $\theta_1$, $\theta_2$, $\theta_3$ and $\theta_4$, respectively, with respect to the front of the listening area. The four signals A, B, C and D transmitted are received by the receiver and decoded by a matrix conversion means in a manner shown by the following formula to reproduce the original signals LF, LR, RR and RF.

$$\begin{bmatrix} LF \\ LR \\ RR \\ RF \end{bmatrix} = \begin{bmatrix} 1 & m\sin\theta_1 & m\cos\theta_1 & n\sin 2\theta_1 \\ 1 & m\sin\theta_2 & m\cos\theta_2 & n\sin 2\theta_2 \\ 1 & m\sin\theta_3 & m\cos\theta_3 & n\sin 2\theta_3 \\ 1 & m\sin\theta_4 & m\cos\theta_4 & n\sin 2\theta_4 \end{bmatrix} \begin{bmatrix} A \\ B \\ C \\ D \end{bmatrix} \quad (2)$$

By supplying the audio signals LF, LR, RR and RF to the four loud speakers respectively, the original sound in the sound field 11 may be reproduced in the listening area 21.

Assuming that $\theta_1=\pi/4$, $\theta_2=\frac{3}{4}\pi$, $\theta_3=5/4\pi$, $\theta_4=7/4\pi$, $m=\sqrt{2}$ and $n=1$, then the formulas (1) and (2) are represented as follows:

$$\begin{bmatrix} A \\ B \\ C \\ D \end{bmatrix} = \begin{bmatrix} 1 & 1 & 1 & 1 \\ 1 & 1 & -1 & -1 \\ 1 & -1 & -1 & 1 \\ 1 & -1 & 1 & -1 \end{bmatrix} \begin{bmatrix} LF \\ LR \\ RR \\ RF \end{bmatrix} \quad (1')$$

$$\begin{bmatrix} LF \\ LR \\ RR \\ RF \end{bmatrix} = \begin{bmatrix} 1 & 1 & 1 & 1 \\ 1 & 1 & -1 & -1 \\ 1 & -1 & -1 & 1 \\ 1 & -1 & 1 & -1 \end{bmatrix} \begin{bmatrix} A \\ B \\ C \\ D \end{bmatrix} \quad (2')$$

Figure 3:
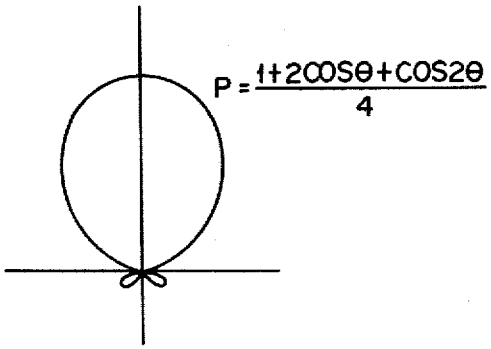
FIGS. 3 and 4 are graphs illustrating cross-talk characteristic of reproduced signal.

In this case a theoretical cross-talk characteristic as shown in FIG. 3 is represented by $$P = \frac{1 + 2\cos\theta + \cos 2\theta}{4}$$

and hence the cross-talk among the respective signals decoded becomes zero.

Figure 4:
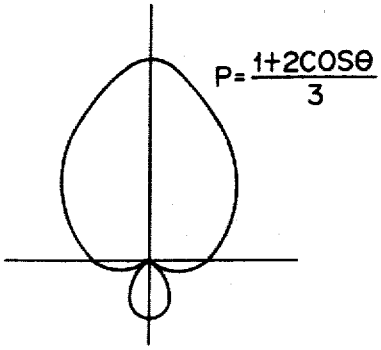

If the code signal D is not received by the receiver the transmission of the audio signals LF, LR, RR and RF is effected by the three code signals A, B and C. In this case, a theoretical cross-talk characteristic is represented by $$P = \frac{1' + 2\cos\theta}{3}$$

as shown in FIG. 4. As seen from the FIG. 4 or the above formula, since the cross-talk component appearing in the signals supplied to the opposing loud speakers are always in opposite phase (180° out of phase) to each other, the sound image fixing effect in the sound reproduction is not damaged in the listening area by said cross-talk component.

Thus, the broadcasting system including the encode means and the decode means having the matrix characteristics as shown in the formulas (1) and (2) ( (1)' and (2)') can maintain a good sound image fixing function even when the code signal D is not activated.

Figure 5:
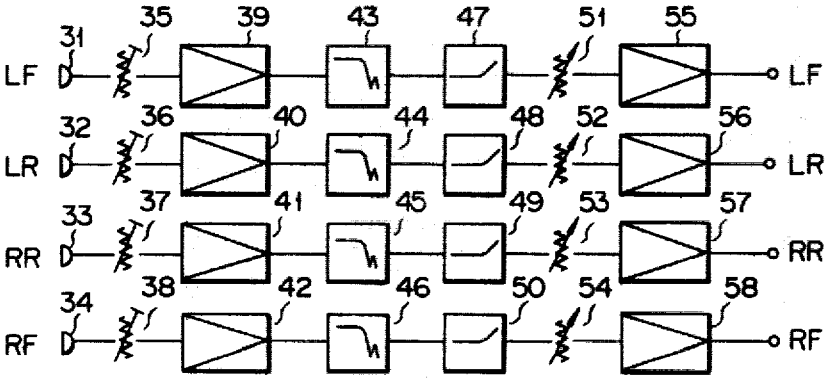
FIGS. 5 and 6 are block diagrams illustrating one embodiment of a transmitter used in the present invention.
Figures 6, 7A, 7B, 7C, 7D, 7E, 7F:
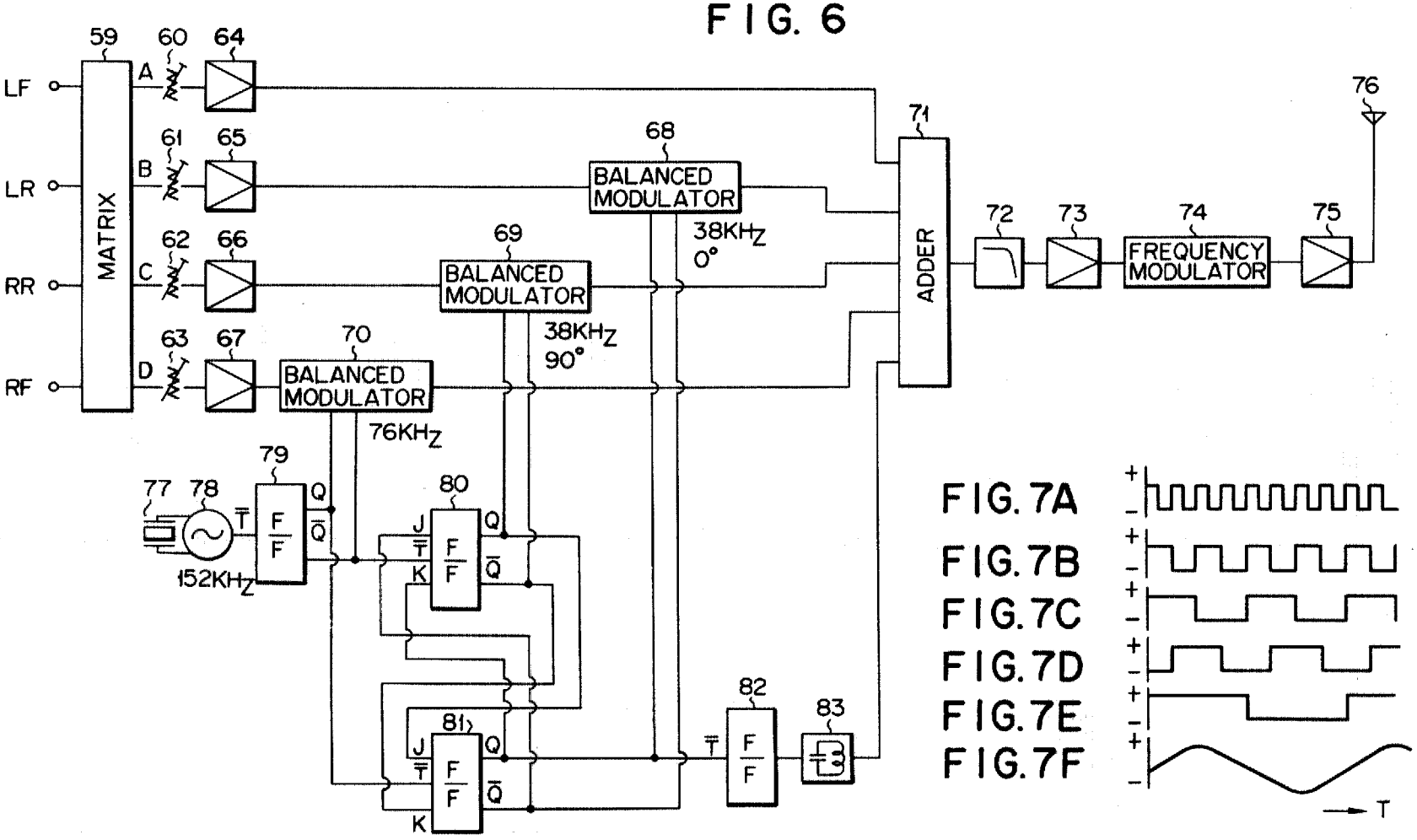
FIGS. 7A through 7F are graphs illustrating waveforms of various output signals generated in the transmitter of FIG. 6.

One embodiment of the transmitter which makes use of the matrix conversion means as described above is now explained. Block diagrams shown in FIGS. 5 and 6 show the transmitter. Four input signals LF, LR, RR and RF from the four microphones 31, 32, 33 and 34 are first attenuated to a predetermined level by pre-volume controls 35, 36, 37 and 38, amplified by amplifiers 39, 40, 41 and 42 and then passed through low-pass filters 43, 44, 45 and 46. The low-pass filters serve to attenuate the audio signals abruptly above the frequency of 15 $KH_z$ in order to prevent pilot signal and subcarrier wave described below from being interfered. The outputs of the low-pass filters are passed to pre-emphasis circuits 47, 48, 49 and 50 where the high frequency band is emphasized. The levels of the outputs of the pre-emphasis circuits are regulated by main volume controls 51, 52, 53 and 54, amplified by amplifiers 55, 56, 57 and 58 and then supplied to an encoding matrix 59. Each of the amplifiers, each of the low-pass filters, each of the pre-emphasis circuits and each of the volume controls described above may be all of conventional ones used in transmitters for ordinary FM stereo broadcast system.

Figure 8:
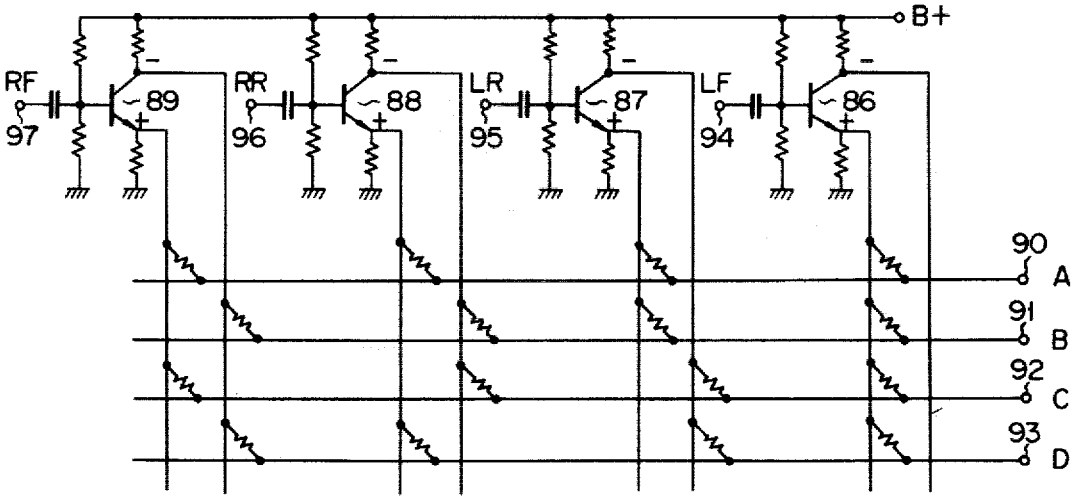
FIG. 8 shows a detailed circuit of the block 59 shown in FIG. 6.

A specific circuit of the encoding matrix 59 is shown in FIG. 8. The encoding matrix circuit 59 comprises transistors 86, 87, 88 and 89, input terminals 94, 95, 96 and 97 each connected to the bases of the above transistors and receiving the signals LF, LR, RR and RF, and output terminals 90, 91, 92 and 93. The output terminals 90, 91, 92 and 93 are suitably connected through respective resistors to emitters or collectors of the transistors 86, 87, 88 and 89- to produce code signals as represented by the following formulas:

$$\begin{aligned} A &= LF + LR + RR + RF \\ B &= LF + LR - RR - RF \\ C &= LF - LR - RR + RF \\ D &= LF - LR + RR - RF \end{aligned} \quad (3)$$

Namely, this encoding matrix circuit effects the matrix conversion as represented by the formula (1)' above.

The levels of the code signals A, B, C and D are again regulated by the volume controls 60, 61, 62 and 63 and then amplified by the amplifiers 64, 65, 66 and 67 as shown in FIG. 6. The signal A which is the output of the amplifier 64 is directly fed to an adder 71. The signal B which is the output of the amplifier 65 is fed to a balanced amplitude modulator 68. The balanced amplitude modulator 68 is supplied with a first subcarrier from the flip-flop 81, which first subcarrier is subjected to suppressed subcarrier amplitude modulation in amplitude modulator 68 in response to the signal B, and the first subcarrier thus modulated is fed to the adder 71. The signal C, after being amplified by the amplifier 66 is supplied to the balanced amplitude modulator 69. The balanced amplitude modulator 69 is supplied with a second subcarrier from a flip-flop 80, which second subcarrier is subjected to suppressed-subcarrier amplitude modulation in the balanced amplitude modulator 69 in response to the signal C and the second subcarrier thus modulated is fed to the adder 71. The signal D amplified by the amplifier 67 is fed to the balanced amplitude modulator 70. The balanced amplitude modulator 70 is supplied with a third subcarrier from a flip-flop 79, which third subcarrier is subjected to suppressed-subcarrier amplitude modulation in the balanced amplitude modulator 70 in response to the signal D, and the modulated wave which is the output of the modulate 70 is fed to the adder 71. The amplifiers 64, 65, 66 and 67 and the balanced amplitude modulators 68, 69 and 70 may be conventional ones used in ordinary broadcasting or communication system and hence detailed description thereof is omitted.

Apparatus for generating the first, second and third subcarrier and the pilot signals will now be described. As shown in FIG. 6, an oscillator 78 including a crystal oscillator element 77 generates signal of 152 $KH_z$. This signal is square wave signal as shown in FIG. 7A. The 152 $KH_z$ square wave signal is used to trigger a well-known flip-flop 79 to produce 76 $KH_z$ square wave (shown in FIG. 7B) which is used as the third subcarrier to be modulated in the balanced amplitude modulator 70. The first output of the flip-flop 79 is used to trigger a well-known J-K flip-flop 81 to produce a first 38 $KH_z$ subcarrier (shown in FIG. 7C), while the second output which is 180° out of phase with respect to the first output is used to trigger the flip-flop 80 to produce a second 38 $KH_z$ subcarrier (as shown in FIG.7D) which is 90° out of phase with respect to the first subcarrier. J and K terminals of the J-K flip-flop 80 and 81 and the output terminals Q and Q were connected as shown in FIG. 6 in such a way that the first subcarrier which is the output of the flip-flop 81 and the second subcarrier which is the output of the flip-flop 80 are 90° out of phase to each other. The output of the flip-flop 81 is used to trigger a well-known flip-flop 82 to produce 19 $KH_z$ square wave as shown in FIG. 7E and this 19 $KH_z$ square wave is converted by any well-known tuning circuit 83 to 19 $KH_z$ sine wave, which in turn is used as the pilot signal. The waveforms of the signals described above and the phase relation among them will be clear from FIGS. 7A through 7F.

The first, second and third modulated subcarriers thus produced, together with the signal A and the pilot signal, are electrically added in the adder 71. Thus, the output signal of the adder 71 is a composite signal as shown by the following formula;

$$f_1(t)=A+B\sin 2\omega t+C\cos 2\omega t+D\sin 4\omega t+K\sin \omega t \quad (4)$$

where K is an appropriate constant. In the present embodiment, $\omega=19{,}000\times 2\pi$, $2\omega=38{,}000\times 2\pi$ and $4\omega=76{,}000\times 2\pi$.

The composite signal may be represented by the frequency spectrum shown in FIG. 12. That is, the composite signal consists of signal components of A signal 95, pilot signal 96, B sideband signal 97, C sideband signal 97 and D sideband signal 98. The level of each signal component may be adjusted by a level adjusting means, described below, included in the adder 71.

Figure 9:
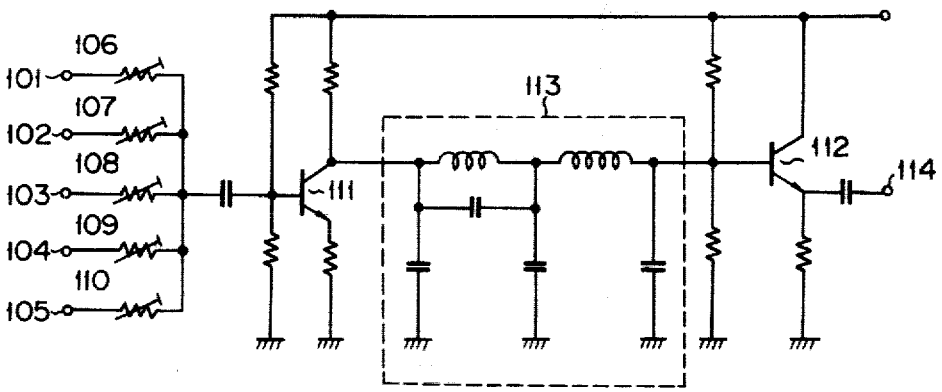
FIG. 9 shows a detailed circuit of the blocks 71 and 72 shown in FIG. 6.
Figure 10:
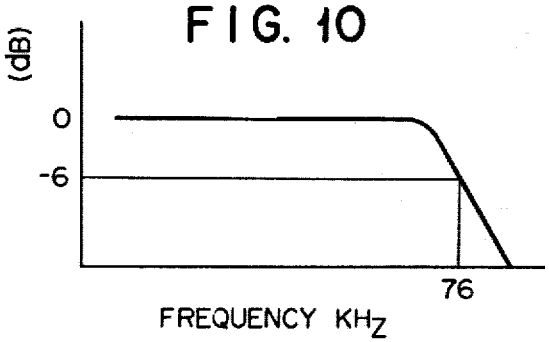
FIG. 10 is a graph illustrating a frequency characteristic of the block 72 shown in FIG. 6.
Figure 11:
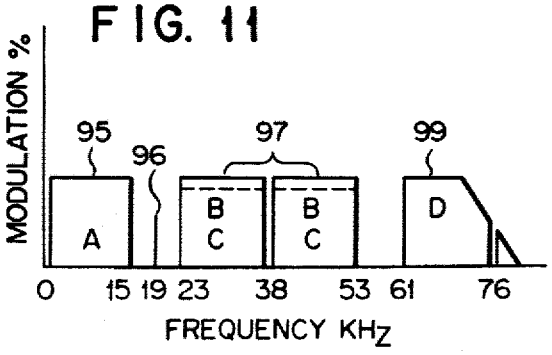
FIG. 11 is a graph illustrating a frequency spectrum of the output signal of the block 72 shown in FIG. 6.

The composite signal from the adder 71 is fed to an amplifier 73 through a low-pass filter 72. The adder 71 and the low-pass filter 72, as shown in FIG. 9, comprise an A signal input terminal 101, a first modulated subcarrier input terminal 102, a second modulated subcarrier input terminal 103, a third modulated subcarrier input terminal 104, a pilot signal input terminal 105, volume controls 106, 107, 108, 109 and 110 for adjusting respective input levels, transistors 111 and 112, L-C circuit 113 and an output terminal 114. The low-pass filter 72 exhibit the frequency characteristic having −6 db attenuation at 76 $KH_z$ ($[2\omega]/\pi$ $H_z$), as shown in FIG. 10. The output of the filter 72 shown in FIG. 11 is such that higher frequency component of the D sideband signal 98 shown in FIG. 12 (i.e the third modulated subcarrier) is cut off to provide so-called VSB (Vestigial sideband) 99. Those signal components shown in FIG. 11 which correspond to those of FIG. 12 are designated similarly and the description thereof is omitted.

The composite signal including the signal components as shown in FIG. 11 is fed from the filter 72 through the amplifier 73 to a frequency modulator 74 which frequency-modulates a main carrier wave depending on the composite signal. The frequency-modulated main carrier wave from the frequency modulator 74 is transmitted from an antenna 76 through a transmitter 75. The amplifier 73, the frequency modulator 74 and the transmitter 75 may be conventional ones used in ordinary FM broadcasting system and hence the description thereof is omitted.

Another embodiment of the transmitter of the present invention will now be described. In FIG. 13, input terminals 121, 122, 123, and 124 are supplied with the audio signals LF, LR, RR and RF, respectively, which are the outputs of the amplifiers 55, 56, 57 and 58 shown in FIG. 5. A two-level switching circuit 125 is connected to the terminals 121 and 122 and it alternately switches the LF signal and the LR signal in response to the first 76 $KH_z$ switching signal from the flip-flop 130. Another two-level switching circuit 126 is connected to the terminals 123 and 124, and it alternately switches the RR signal and the RF signal in response to the first 76 $KH_z$ switching signal from the flip-flop 130. The outputs of the switching circuits 125 and 126 are fed to a further two-level switching circuit 127, which alternately switches the output of the switching circuit 125 and the output of the switching circuit 126 in response to the second 38 $KH_z$ switching signal from the flip-flop 131. The output of the switching circuit 127 is sequentially and repetitively switched from the LF signal to the RR signal, from the RR signal to the RF signal, and from the Rf signal to the LF signal. The output signal of the switching circuit 127 is thus expressed by the following Fourier expression;

$$\begin{aligned} F &= a_0 + (a_1\sin x + a_2\sin 2x + \ldots + a_n\sin nx) + (b_1\cos x + b_2\cos 2x + \ldots + b_n\cos nx) \quad (5)\\ &= (LF + LR + RR + RF) + (LF + LR - RR - RF)\sin x + (LF - LR + RR - RF)\sin 2x + \ldots + a_n\sin nx + b_n\cos nx\\ &= A + B\sin 2\omega t + C\cos 2\omega t + D\sin 4\omega t + \ldots + a_n\sin n2\omega t + b_n\cos n2\omega t \end{aligned}$$

where $x=2\omega t$, see also the formula (3).

The switching signals are produced in the following manner. The oscillator 129 including the crystal oscillator element 128 generates 152 $KH_z$ square wave as shown in FIG. 14A, which in turn triggers the flip-flop 130 to generate a first switching signal consisting of 76 $KH_z$ square wave as shown in FIG. 14B. This first switching signal is fed to the switching circuit 125 and the switching circuit 126 as described before. The first switching signal is also used to trigger the flip-flop 131 to generate a second switching signal consisting of 38 $KH_z$ square wave as shown in FIG. 14C. The second switching signal is fed to the switching circuit 127 as described before and also used to trigger the flip-flop 132 to produce 19 $KH_z$ square wave. This 19 $KH_z$ square wave passes through the tuning circuit 133 to produce a pilot signal consisting of 19 $KH_z$ sin wave, which is then passed to the adder 135. The terminals 121, 122, 123 and 124 are connected to an input of a channel separation control circuit 134, the output of which is fed to the adder 135.

The output signal of the adder 135 is a composite signal expressed by the following formula;

$$S_2(t) = A + B\sin 2\omega t + C\cos 2\omega t + D\sin 4\omega t + K\sin \omega t + \ldots \quad (6)$$
$$\ldots + a_n \sin n2\omega t + b_n \cos n2\omega t$$

where $\omega = 19{,}000 \times 2\pi$,
$4\omega = 76{,}000 \times 2\pi$
$2\omega = 38{,}000 \times 2\pi$
K: constant The composite signal is passed through the low-pass filter 136 to have its high frequency component cut off. The low-pass filter 136 is identical to the low-pass filter of FIG. 6 and exhibits the frequency characteristic, as shown in FIG. 10, having −6 db attenuation at 76 $KH_z$. Thus, the output signal of the low-pass filter 136 is expressed by the following formula;

$$S_2(t) = A + B \sin 2\omega t + C \cos 2\omega t + D \sin 4\omega t + K \sin \omega t \ldots \quad (7)$$

where $\omega = 19{,}000 \times 2\pi$,
$4\omega = 76{,}000 \times 2\pi$
$2\omega = 38{,}000 \times 2\pi$
K: constant The frequency spectrun of this output signal is as shown in FIG. 11 and identical to the composite signal expressed by the formula (4), which is obtained by the first embodiment of the transmitter described above.

The composite signal, like the first embodiment (shown in FIG. 6) of the transmitter, is passed through the amplifier 137 to the frequency modulator 138. In the frequency modulator 138, main carrier wave is frequency-modulated depending upon the composite signal and the resulting modulated main carrier wave is transmitted from an antenna 140 through a transmitter 139.

Figure 16:
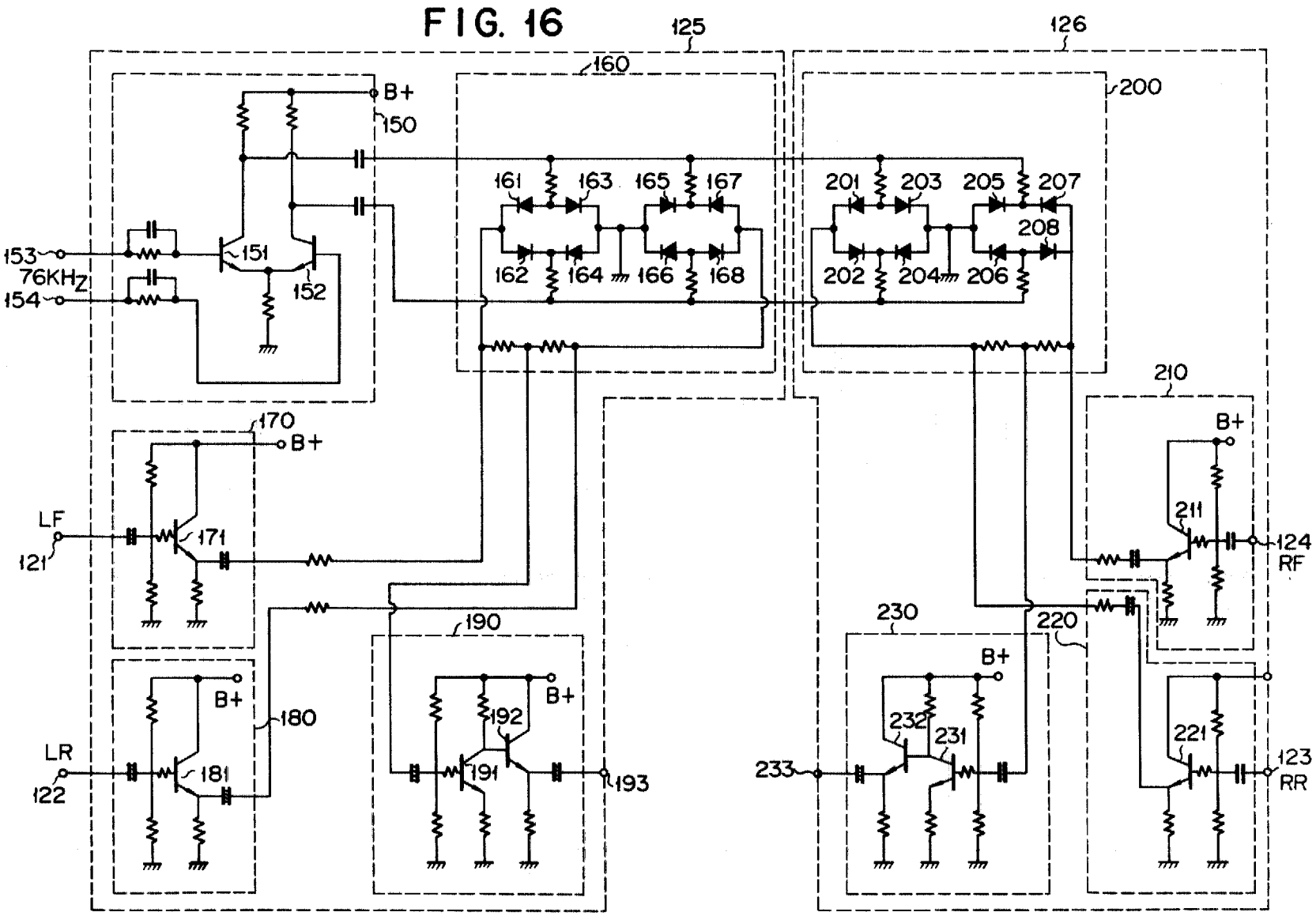
Figure 17:
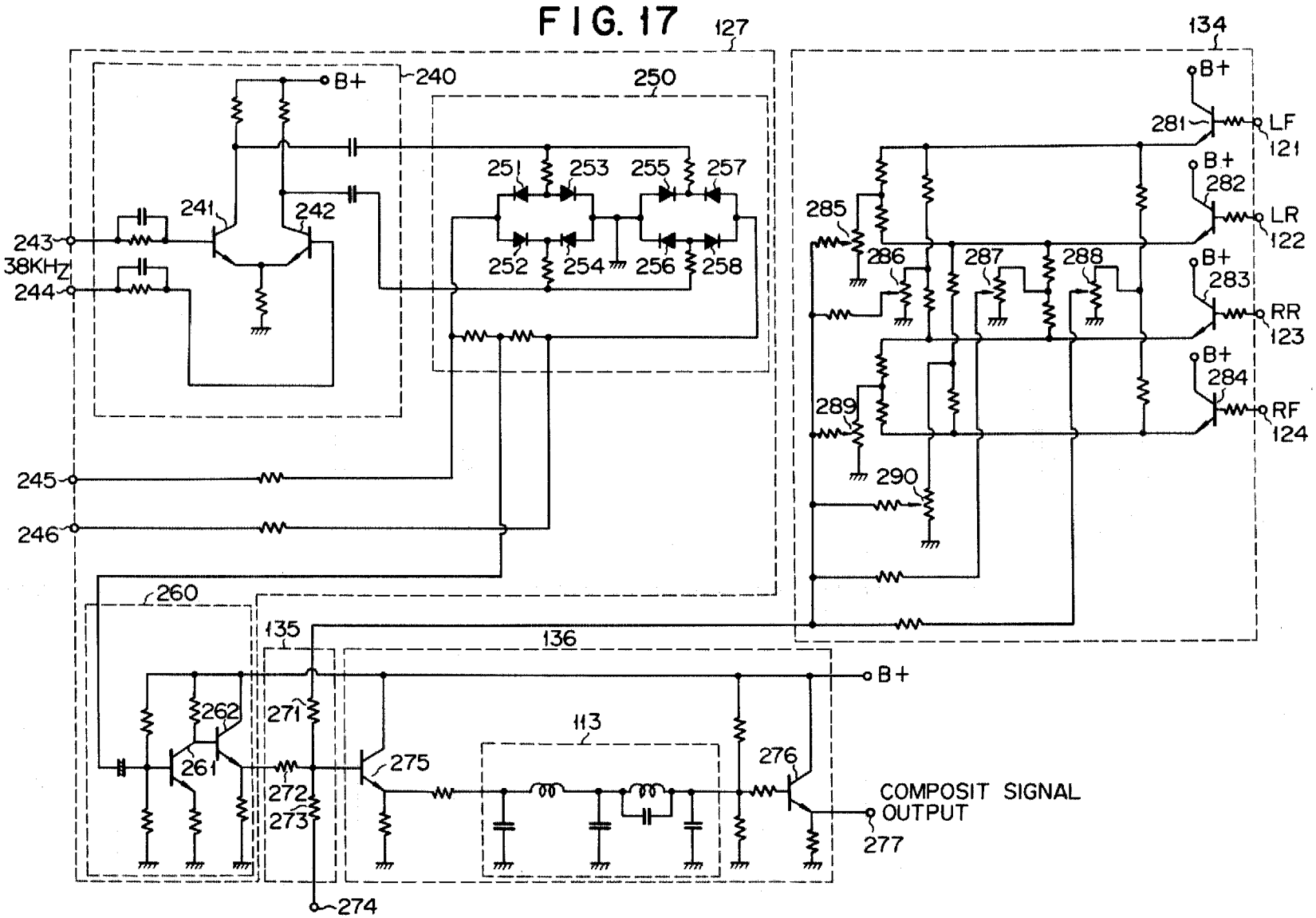

The transmitter of FIG. 13 may be formed by specific circuits as shown in FIGS. 16 and 17 in which those circuits which correspond to the blocks in FIG. 13 have corresponding designations. The oscillator 129, flip-flops 130, 131, 132 and the tuning circuit 133 may be conventional ones and hence they are not described further. The switching circuit 125 comprises an amplifier 170 which amplifies the LF signal i.e. an input signal, an amplifier 180 which amplifies the LR signal i.e. an input signal, a differential amplifier 150 which amplifies the switching signal, a diode switch 160 and an amplifier 190 which amplifies the switched signal. The amplifier 170 comprises a transistor 171 having its base connected to the LF signal input terminal 121. The amplifier 180 comprises a transistor 181 having its base connected to the LR signal input terminal 122. The differential amplifier 150 comprises input terminals 153 and 154 for 76 $KH_z$ switching signal, a transistor 151 having its base connected to the terminal 153 and a transistor 152 having its base connected to the terminal 154. The diode switch 160 includes eight diodes 161, 162, 163, 164, 165, 166, 167 and 168. The amplifier 190 includes transistors 191 and 192 and an output terminal 193.

The switching circuit 126 comprises amplifiers 210 and 220 for amplifying the input signals, a diode switch 200 and an amplifier 230 which amplifies the switched signal. The amplifier 210 includes a transistor 211 having its base connected to an RF signal input terminal 124 and the amplifier 220 comprises a transistor 221 having its base connected to an RR signal input terminal 123. The diode switch 200 comprises eight diodes 201, 202, 203, 204, 205, 206, 207 and 208. The amplifier 230 comprises transistors 231 and 232 and an output terminal 233 connected to an emitter of the transistor 233.

The switching circuit 127 includes input terminals 245 and 246 for two signals to be switched, a differential amplifier 240 for amplifying the switching signal, a diode switch 250 and an output amplifier 260. The differential amplifier 240 comprises input terminal 243 and 244 for 38 $KH_z$ switching signal and transistors 241 and 242 each having its base connected to said terminals. The diode switch 250 comprises eight diodes 251, 252, 253, 254, 255, 256, 257 and 258. The amplifier 260 comprises transistors 261 and 262. The output terminal 193 of the switching circuit 125 is connected to the input terminal 245 of the switching circuit 127, while the output terminal 233 of the switching circuit 126 is connected to the input terminal 246 of the switching circuit 127. The switching signal input terminals 153 and 154 of the switching circuit 125 is connected to the output terminal of the flip-flop 130, as shown in FIG. 13, while the input terminals 243 and 244 of the switching circuit 127 are connected to the output terminal of the flip-flop 131.

Thus, the LF signal and the LR signal supplied to the terminals 121 and 122, respectively, are, after being amplified by the amplifiers 170 and 180, passed to the diode switch 160, to which 76 $KH_z$ switching signal is fed from the differential amplifier 150. The diode switch 160 thus alternately switches the LF signal and the LR signal in response to the switching signal. The switched signal produced by alternately switching the LF signal level and the LR signal level is amplified by an amplifier 190 to produce an output signal at an output terminal 193. On the other hand, the RR signal and the LR signal supplied to the terminals 123 and 124 are, often being amplified by the amplifiers 220 and 210, respectively, passed to a diode switch 200, to which 76 $KH_z$ switching signal which is identical to the switching signal supplied to the diode switch 160 is fed from the differential amplifier 150. In response to this switching signal, the RR signal and the RF signal are alternately switched, and the resulting switched signal appears at an output terminal 233 through an amplifier 230.

The two switched signals produced at the terminals 193 and 233 are fed to a diode switch 250 through input terminals 245 and 246, respectively, of the switching circuit 127. The diode switch 250, in response to the 38 $KH_z$ switching signal supplied from the differential amplifier 240, alternately switches the two signals supplied to the input terminals 245 and 246, and the resulting switched signal is amplified by the amplifier 260. The output of the amplifier 260 has a waveform as shown in FIG. 15.

A channel separation control circuit 134 includes four transistors 281, 282, 283 and 284 and variable resistors 285, 286, 287, 288, 289 and 290. The bases of the transistors are respectively connected to the input terminals 121, 122, 123, and 124 for LF, LR, RR and RF signals.

The output of the channel separation control circuit 134 is electrically added in the adder 135 through a resistor 271 with the output signal of the switching circuit 127 through a resistor 272 and the 19 $KH_z$ pilot signal from the tuning circuit 133 through a resistor 273.

The output of the adder 135 is fed to a low-pass filter 136. In the low-pass filter 136, the output of the adder 135 appears at an output terminal 277 as a composite signal through a transistor 275, L-C circuit 113 (which corresponds to the L-C circuit shown in FIG. 9) and a transistor 276.

Figure 18:
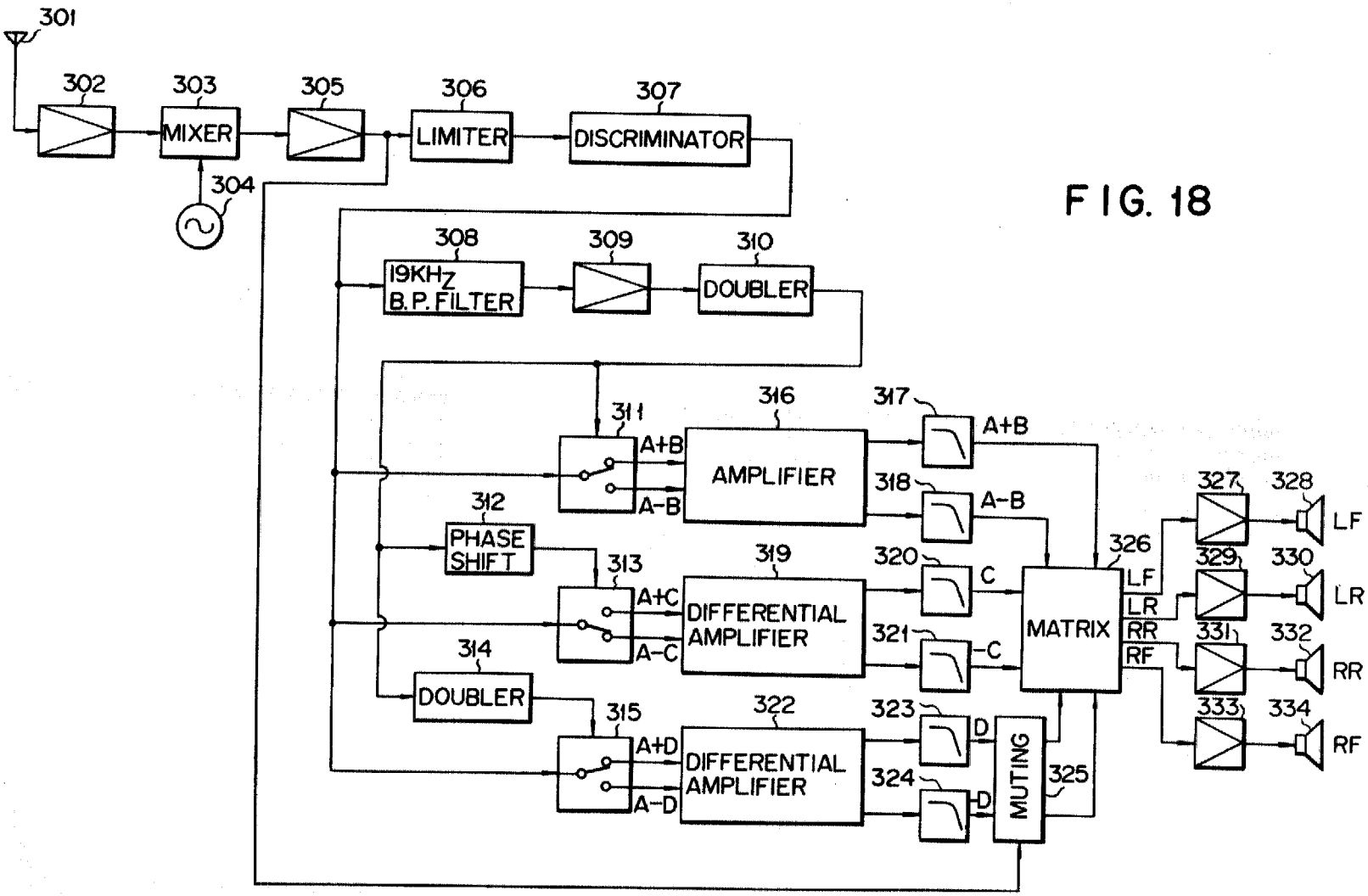
FIG. 18 is a block diagram showing one embodiment of a receiver of the present invention.

An embodiment of a receiver used in the broadcasting system according to the present invention will now be described. As shown in FIG. 18, a receiver antenna 301 is connected to a mixer 303 through a radio frequency amplifier 302. A local oscillator 304 is connected to the mixer 303, the output of which is connected to a discriminator 307 through an intermediate frequency amplifier 305 and a limiter 306. The output of the discriminator 307 is connected to a switching circuit 311 via a band-pass filter 308 which passes 19 $KH_z$ pilot frequency, a pilot signal amplifier 309 and a doubler 310. The switching circuit 311 is supplied with a composite signal from the output of the discriminator 307, and the composite signal is switched depending upon the 38 $KH_z$ output of the doubler 310 to produce A+B signal and A−B signal. The arrangement described above is the same as that of a conventional FM stero receiver except that the discriminator 307 is capable of passing modulating frequency of 76 $KH_z$. The outputs of the switching circuit 311 are coupled to a decoding matrix circuit 326 through an amplifier 316 and deemphasis networks 317 and 318. The output of the doubler 310 is connected to the switching circuit 313 via phase shifting means 312 acting to shift the phase by 90°. The switching circuit 313 is connected to the output of the discriminator 307. The composite signal from the output of the discriminator 307 is switched depending upon the 38 $KH_z$ switching signal which is phase-shifted by 90°, to produce A+C signal and A−C signal. The two outputs of the switching circuit 313 are connected to a matrix circuit 326 through the differential amplifier 319 and the deemphasis networks 320. The output of the doubler 310 is also coupled to the switching circuit 315 through the doubler 314. The switching circuit 315 is also connected to the output of the discriminator 307. The composite signal supplied from the output of the discriminator 307 is switched in response to the 76 $KH_z$ switching signal produced at the output of the doubler 314 to produce A+D signal and A−D signal. The outputs of the switching circuit 315 are coupled to a matrix 326 through a differential amplifier 322, deemphasis networks 323 and 324 and preferably through a muting circuit 325. The muting circuit 325 is connected to the output of the intermediate frequency amplifier 305, and interrupts the connection of the deemphasis networks 323 and 324 with the matrix 326 depending on the output level of the intermediate frequency amplifier.

The output of the matrix 326 consists of the LF, LR, RR and RF signals, each of which is fed to loud speakers 328, 330, 332 and 334, respectively, through respective audio power amplifier 327, 329, 331 and 333. The loud speaker 328 is positioned near left-forward of a listener, the loud speaker 330 near left-rearward, the loud speaker 332 near right-rearward and the loud speaker 334 near right-forward, (see FIG. 2).

Figure 19:
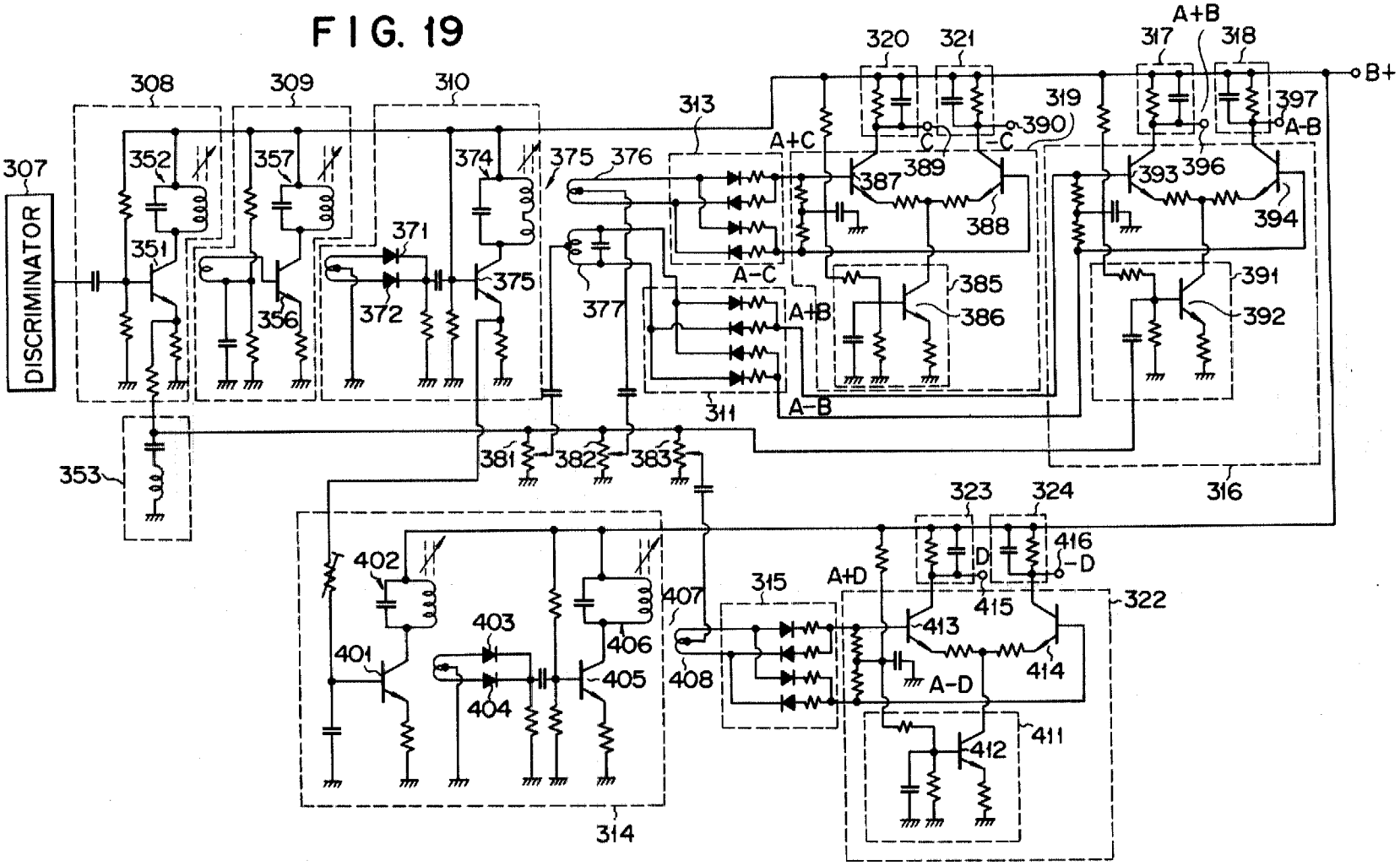
FIG. 19 is a detailed circuit diagram of the embodiment shown in FIG. 18.

In FIG. 19 there is shown a detailed circuit diagram for the blocks 308–324 of FIG. 18. A composite signal supplied from the output of the discriminator 307 is passed to a bandpass filter 308 comprising a transistor 351 and a resonant network 352 tuned to 19 $KH_z$ to produce 19 $KH_z$ pilot signal, which in turn passes through a pilot amplifier 309 comprising a a transistor 356 and a resonant network 357 tuned to 19 $KH_z$, to a doubler 310 comprising diodes 371 and 372, a transistor 373 and a resonant network 374 tuned to 38 $KH_z$ to produce 38 $KH_z$ carrier wave. A first 38 $KH_z$ switching signal is produced on a secondary coil 377 of a transformer 375 and a second 38 $KH_z$ switching signal is produced on another secondary coil 376, the second switching signal being 90° out of phase with respect to the first switching signal. To center taps of the secondary coils 377 and 376, the composite signal having 19 $KH_z$ pilot signal eliminated is supplied through variable resistors 381 and 382, respectively, from the emitter of the transistor 351, preferably through a trap circuit comprising a resonant circuit tuned to 19 $KH_z$. A switching circuit 311 comprising four diodes switches the composite signal supplied to the coil 377 in response to the first 38 $KH_z$ switching signal to produce A+B signal and A−B signal, the both signals being fed to an amplifier 316 comprising transistors 393 and 394 and a amplifier 391. The constant current circuit 391 comprises a transistor 392, to the base of which the composite signal is fed. The amplifier 316 produces A+B signal and A−B signal which appear at output terminals 396 and 397 through deemphasis networks 317 and 318.

The switching circuit 313 comprising four diodes switches the composite signal supplied to the coil 376 in response to the second 38 $KH_z$ switching signal to produce A+C signal and A−C signal. These signals are fed to a differential amplifier 319 comprising a constant current circuit including a transistor 386 and transistor 387 and 388 to produce differential signals C and −C. The signals C and −C from the output of the differential amplifier are passed to the output terminals 389 and 390 through the deemphasis circuits 320 and 321.

The 38 $KH_z$ carrier wave from the emitter of the transistor 373 is passed through a transistor 401, a resonant network 402 tuned to 38 $KH_z$, diodes 403, 404, transistor 405, and a resonant network tuned to 76 $KH_z$ to produce 76 $KH_z$ carrier wave which is induced on a secondary coil 408 of the transformer 407. To the center top of the secondary coil 408 the composite signal is supplied through a variable resistor 383. The switching circuit 315 comprising four diodes switches the composite signal in response to 76 $KH_z$ switching signal to produce A+D signal and A−D signal, which are then fed to a differential amplifier 322 comprising a constant current circuit 411 including a transistor 412 and transistor 413 and 414 to produce D signal and −D signal. The signals D and −D are then fed to the output terminals 415 and 416 through deemphasis networks 323 and 324.

FIG. 20 shows a detailed circuit diagram of the muting circuit shown by the block 325 in FIG. 18. The muting circuit consists of diodes 421 and 422, a variable resistor 423, transistors 424 and 425, manual switch 426 and field effect transistors (FET) 427 and 428. A drain of the FET 427 is connected to the output terminal 515 of the deemphasis network 323, a gate thereof is connected to a junction of one of contacts of the switch 426 and a collector of the transistor 425 through a resistor, and a source thereof is connected to the output terminal 429. The output terminal 429 is connected to a matrix circuit 326 described below. A drain of the FET 428 is connected to the output terminal 416 of the deemphasis network 324, a gate thereof is connected to said junction of one of contacts of the switch 426 and the collector of the transistor 425 through a resistor, and a source thereof is connected to the matrix circuit 326 described later. The switch 426 is normally held open. Thus, when the receiver antenna 301 does not receive a broadcasting wave or an electric field intensity of the broadcasting wave received by the receiver antenna is too low, the level of the output signal of the intermediate frequency amplifier 305 is low, the transistor 424 is in its off condition, the transistor 425 is in its on condition, the gate potentials of the FET's 427 and 428 are low and hence the FET's 427 and 428 are in off condition so that the conductions between the terminals 415 and 429 and between the terminals 416 and 430 are blocked and the D signal and the −D signal are not fed to the matrix 326. When the field intensity of the broadcasting wave is sufficiently high, the transistor 424 is in its on condition while the transistor 425 is in its off condition so that the potentials of the gates of the FET's 427 and 428 are high and hence the FET's 427 and 428 are in on condition. If the switch 426 is closed, the FET's 427 and 428 are always kept in off state so that the D signal and the −D signal are not passed.

Figure 21:
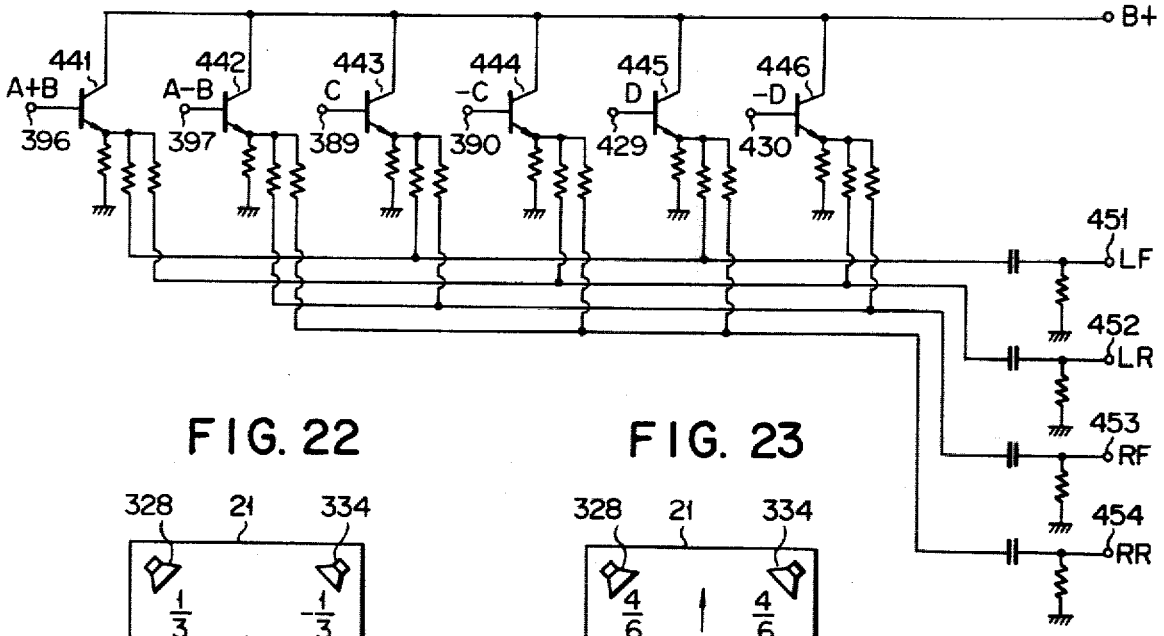
FIG. 21 is a detailed circuit diagram of the block 321 shown in FIG. 18, FIGS. 22 and 23 are schematic diagrams illustrating sound reproduction by the receiver shown in FIG. 18.

FIG. 21 shows a detailed circuit diagram of the decoding matrix 326. The bases of the transistors 441 and 442 are connected to the output terminals 396 and 397 of the deemphasis networks 317 and 318, respectively, to produce A+B signal and A−B signal at their respective emitters. The bases of the transistors 443 and 444 are connected to the output terminals 389 and 390 of the deemphasis networks 320 and 321, respectively, to produce C signal and −C signal at their respective emitters. The bases of the transistors 445 and 446 are connected to the output terminals 429 and 430 of the muting circuit 325, respectively, to produce D signal and −D signal at their respective emitters. The output terminals 451, 452, 453 and 454 are suitably connected through resistors to the emitters of the transistors 441 to 446 to produce the LF, LR, RF and RR signals provided by the matrix conversion as represented by the following formula; (See the previous formula (2'))

$$\left.\begin{aligned} LF &= A + B + C + D \\ LR &= A + B - C - D \\ RR &= A - B - C + D \\ RF &= A - B + C - D \end{aligned}\right\} \quad (7)$$

These audio signals are fed to the loud speakers via respective power amplifiers. Since the present receiver need not include a filter in the decoder section the manufacturing cost is respectively low.

According to the present broadcasting system including the transmitters and the receivers as described hereinabove, since the peak level of the composite signal is relatively low, the average frequency deviation at the transmitting station may be large resulting in the advantages of good signal to noise ratio. The baseband of the broadcasting wave is advantageously narrow. The broadcasting wave may be used in compatible manner in a conventional 2-channel stereo receiver or monophonic receiver. In a conventional 2-channel stereo receiver; A+B(=LF+LR) signal is produced in a left channel and A−B(=RF+RR) signal is produced in a right channel by means of switching. In a monophonic receiver A(=LF+LR+RR+RF) signal only is demodulated.

Since the receiver of the present invention may be equipped with a muting circuit for blocking the D signal, it is possible to obtain an audio signal having a good signal-to-noise ratio. Where the receiver is at a distant place from a broadcasting station, that is, when the density of the electric field caught by the receiver antenna is low, the muting circuit 325 is automatically activated to cut off the D signal which includes the noise component most. If desired a manual switch 426 may be closed to cut off the D signal. In this manner the audio signals having less noise component can be reproduced. Where the D signal is cut off in the manner as described above, the audio signals fed to the loud speakers are represented by the following formulas;

$$\left.\begin{aligned} LF &= \tfrac{1}{3}(A + B + C) = \tfrac{1}{3}(3LF + LR - RR + RF) \\ LR' &= \tfrac{1}{3}(A + B - C) = \tfrac{1}{3}(LF + 3LR + RR - RF) \\ RR' &= \tfrac{1}{3}(A - B - C) = \tfrac{1}{3}(-LF + LR + 3RR + RF) \\ RF' &= \tfrac{1}{3}(A - B + C) = \tfrac{1}{3}(LF - LR + RR + 3RF) \end{aligned}\right\} \quad (8)$$

Thus, when the microphones are positioned in the sound field as shown in FIG. 1, the audio signals picked up by the microphones 12, 13, 14 and 15 each represented by LF, LR, RR and RF can assume conditoin of LR=1, LF=RR=RF=0 if the sound is generated in the immediate vicinity of the microphone 13. The signals reproduced by the receiver under this condition are represented by the following formulas;

$$\left.\begin{aligned} LF' &= \tfrac{1}{3} \\ LR' &= 1 \\ RR' &= \tfrac{1}{3} \\ RF' &= -\tfrac{1}{3} \end{aligned}\right\} \quad (9)$$

Figure 22:
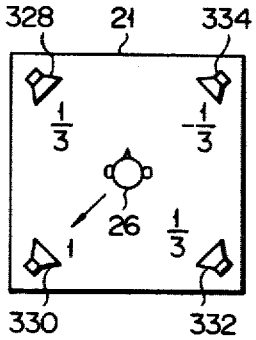

Thus, as shown in FIG. 22, the loud speaker 328 positioned left-forwardly of a listener 26 in the listening area 21 generates a sound at "$\frac{1}{3}$" level, the loud speaker 330 positioned left-rearwardly generates a sound at "1" level, the loud speaker 332 positioned right-rearwardly generates a sound at "$\frac{1}{3}$" level, and the loud speaker 334 positioned rear-forwardly generates a sound at "$-\frac{1}{3}$" level, that is, "$\frac{1}{3}$" level with opposite phase. As a result the listener 26 who sits at the center of the four loud speakers feels as if the sound is generated from left rearward position (in the direction of the arrow). Now, in the field 11 within which four microphones are used to pich up sound, let us assume that the sound is generated intermediate the microphones 12 and 15, that is, in the front of the field and the signals picked up by each of the microphones are represented by the following formula;

$$\left.\begin{aligned} LF &= \tfrac{1}{2} \\ LR &= 0 \\ RR &= 0 \\ RF &= \tfrac{1}{2} \end{aligned}\right\} \quad (10)$$

Then, the signals reproduced by the receiver may be expressed as follows;

$$\left.\begin{aligned} LF'' &= \tfrac{4}{6} \\ LR'' &= 0 \\ RR'' &= 0 \\ RF &= \tfrac{4}{6} \end{aligned}\right\} \quad (11)$$

Figure 23:
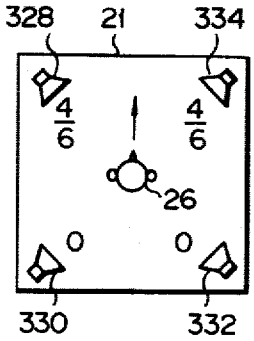

Accordingly, as shown in FIG. 23, only the loud speakers 328 and 334 positioned in front of the listener 26 in the listening area 21 generate the sound at "4/6" level, while the loud speakers 330 and 332 positioned rearwardly do not generate sound. As a result the listener 26 feels as if the sound is generated at the front (in the direction of the arrow).

As described above, even when the D signal is not used by the receiver the sound generating position in the original sound field 11 can be reproduced accurately in the reproducing sound field 21. Thus, where the receiver is at a distant place from the broadcasting station, the listener can enjoy four-channel broadcasting to a practically allowable extent with less noise by cutting off the D signal.

FIGS. 24 to 29 illustrate second, third and fourth embodiments of the decoder section used in the receiver forming a part of the present broadcasting system. Throughout FIGS. 18, 19 and FIGS. 24 to 29, the similar reference numbers are used for the corresponding circuits and circuit components.

Figure 24:
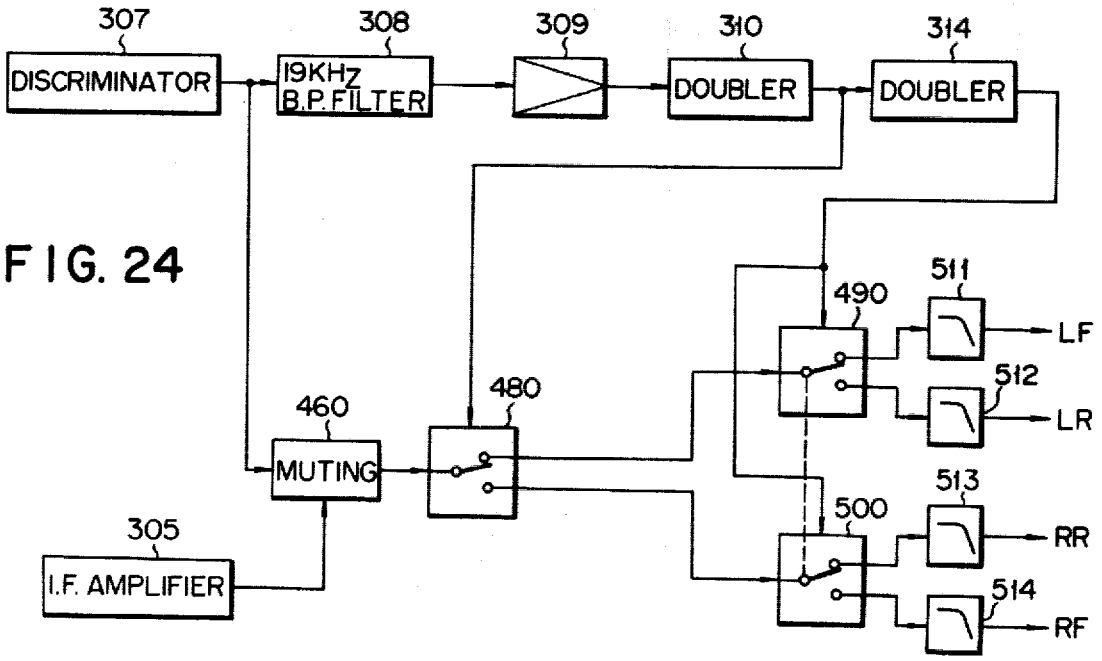
FIG. 24 is a block diagram illustrating a second embodiment of the receiver of the present invention.

In FIG. 24, the output of the discriminator 307 is coupled to the doubler 310 through the 19 $KH_z$ bandpass filter 308 and the amplifier 309. The output of the doubler 310 is connected to the switching circuit 480 and also to the switching circuits 490 and 500 through the doubler 304. The output of the discriminator 307 is also connected to the switching circuit 480 through the muting circuit 460, which, in turn, is connected to the intermediate frequency amplifier 305. Two outputs of the switching circuit 480 are connected to the inputs of the switching circuits 490 and 500, respectively. The outputs of the switching circuits 490 and 500 are passed through the deemphasis circuits 511, 512, 513 and 514 to produce four audio signals represented by LF, LR, RR and RF.

Figure 25:
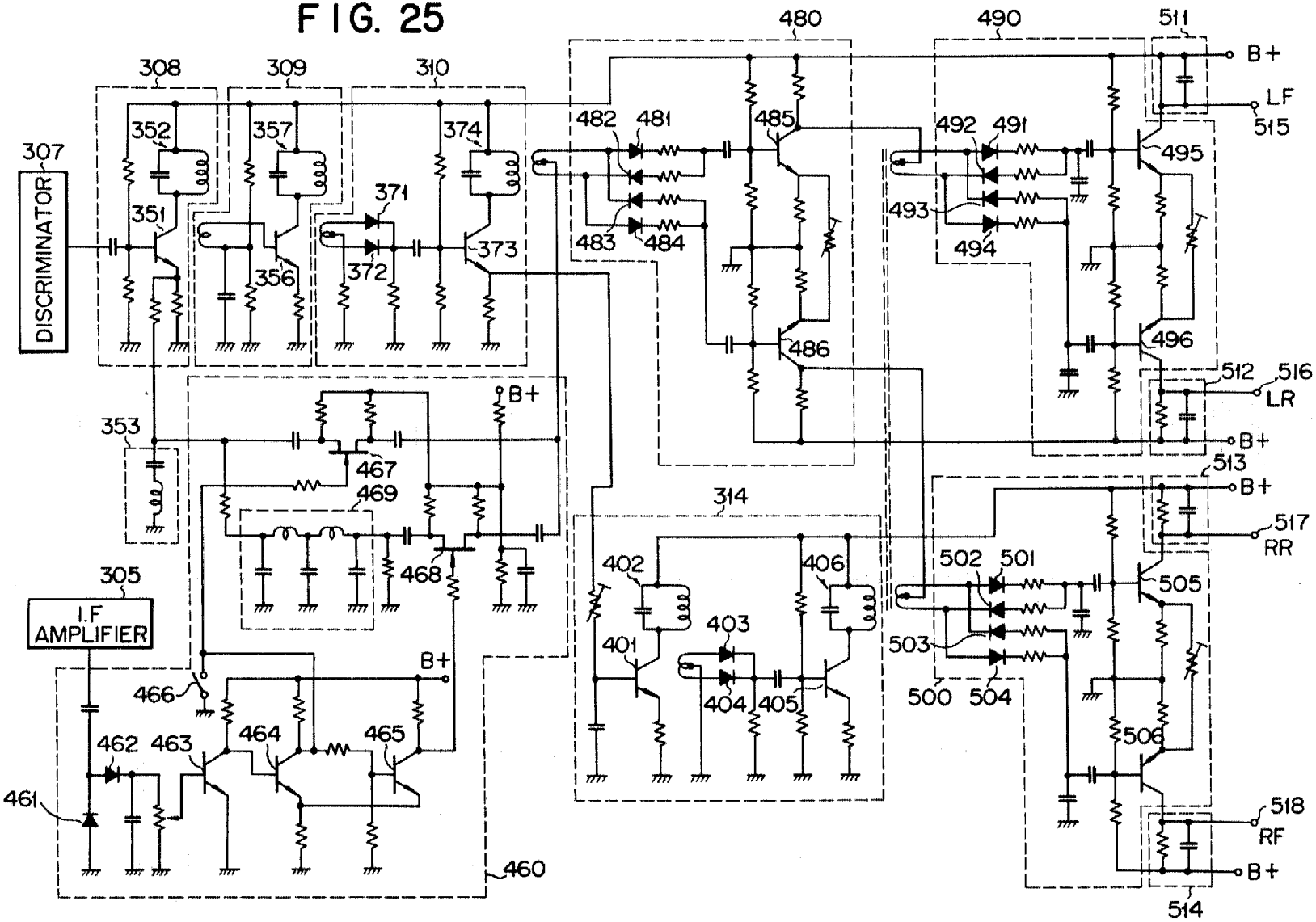
FIG. 25 is a detailed circuit diagram of the embodiment shown in FIG. 24.

In FIG. 25, the muting circuit 460 consists of diodes 461 and 462, a transistor 463, transistors 464 and 465 forming a Schmidt circuit, field effect transistors (FET) 467 and 468, a filter network 469 and a manual switch 466. Assuming that the switch 466 is in open position, if the output signal level from the intermediate frequency amplifier 305 is sufficiently high, the transistor 463 is in its condition, the transistor 464 is off, and the transistor 465 is on so that the FET 467 is in conductive state while the FET 468 is in non-conductive state. Under these conditions, the composite signal fed from the discriminator 307 is supplied to the switching circuit 480 through the transistor 351 forming a filter 308, a trap circuit 353 and through the drain and the source of the FET 467. On the other hand, if the output signal level from the intermediate frequency amplifier 305 is low, the transistor 463 is in its off condition, the transistor 464 is on, the transistor 465 is off so that the FET 467 is in non-conductive state and the FET 468 is conductive state. As a result, the composite signal passes through the filter network 469 and the drain and the source of the FET 468 to the switching circuit 480. When the manual switch 466 is closed, the FET 467 is in non-conductive state while the FET 468 is in conductive state. The filter network 469 is a low-pass filter having a cut-off frequency of 53 $KH_z$.

When the FET 467 in the muting circuit is on and the FET 468 is off, the composite signal is passed to the switching circuit 480 as it is. The switching circuit 480 comprises four diodes 481, 482, 483 and 484 and transistors 485 and 486. The composite signal is switched in response to the 38 $KH_z$ switching signal to produce output signals alternately at the collector of the transistor 485 and the collector of the transistor 468. The collector of the transistor 485 is connected to the switching circuit 490, which consists of four diodes 491, 492, 493 and 494 and transistors 495 and 496. The signal fed from the collector of the transistor 485 is switched in response to the 76 $KH_z$ output signal of the doubler 314 to produce the output signals at the collectors of the transistors 495 and 496, which output signals appear at respective output terminals 515 and 516 as the LF signal and the LR signal, respectively, through the deemphasis circuits 511 and 512. The collector of the transistor 486 is connected to the switching circuit 500 comprising four diodes 501, 502, 503 and 504 and transistors 505 and 506. The signal produced at the collector of the transistor 486 is switched in response to the 76 $KH_z$ switching signal which is the output of the doubler 314 to produce output signals at the collectors of the transistors 505 and 506, which output signals appear at the output terminal 517 and 518 as the RR signal and the RF signal, respectively, through the deemphasis circuits 513 and 514.

When the FET 467 of the muting circuit 460 is in off condition and the FET 468 is on, the composite signal has its D signal which is carried by the 76 $KH_z$ subcarrier cut off by the filter circuit 469 and then passed to the switching circuit 480. As a result, the audio signals produced at the output terminals 515, 516, 517 and 518 are represented by LF', LR', RR' and RF' given by the previous formulas (8).

Figure 26:
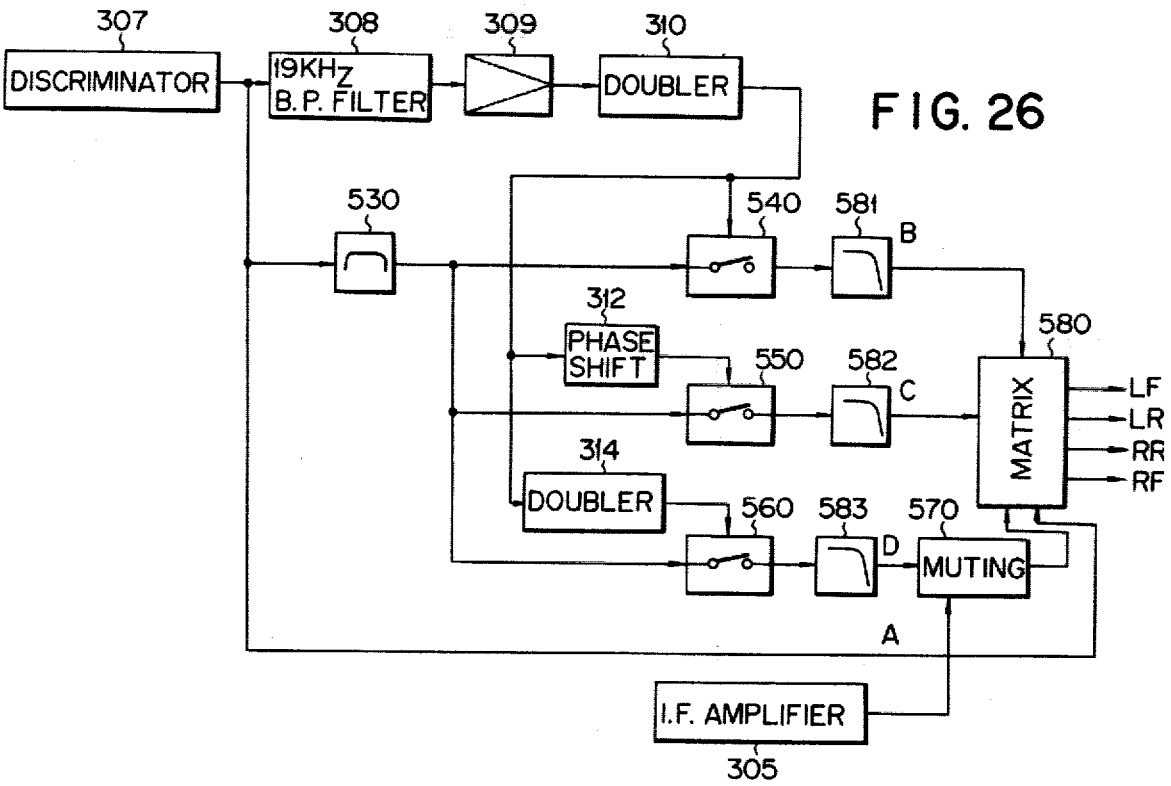
FIG. 26 is a block diagram illustrating a third embodiment of the receiver of the present invention.
Figure 27:
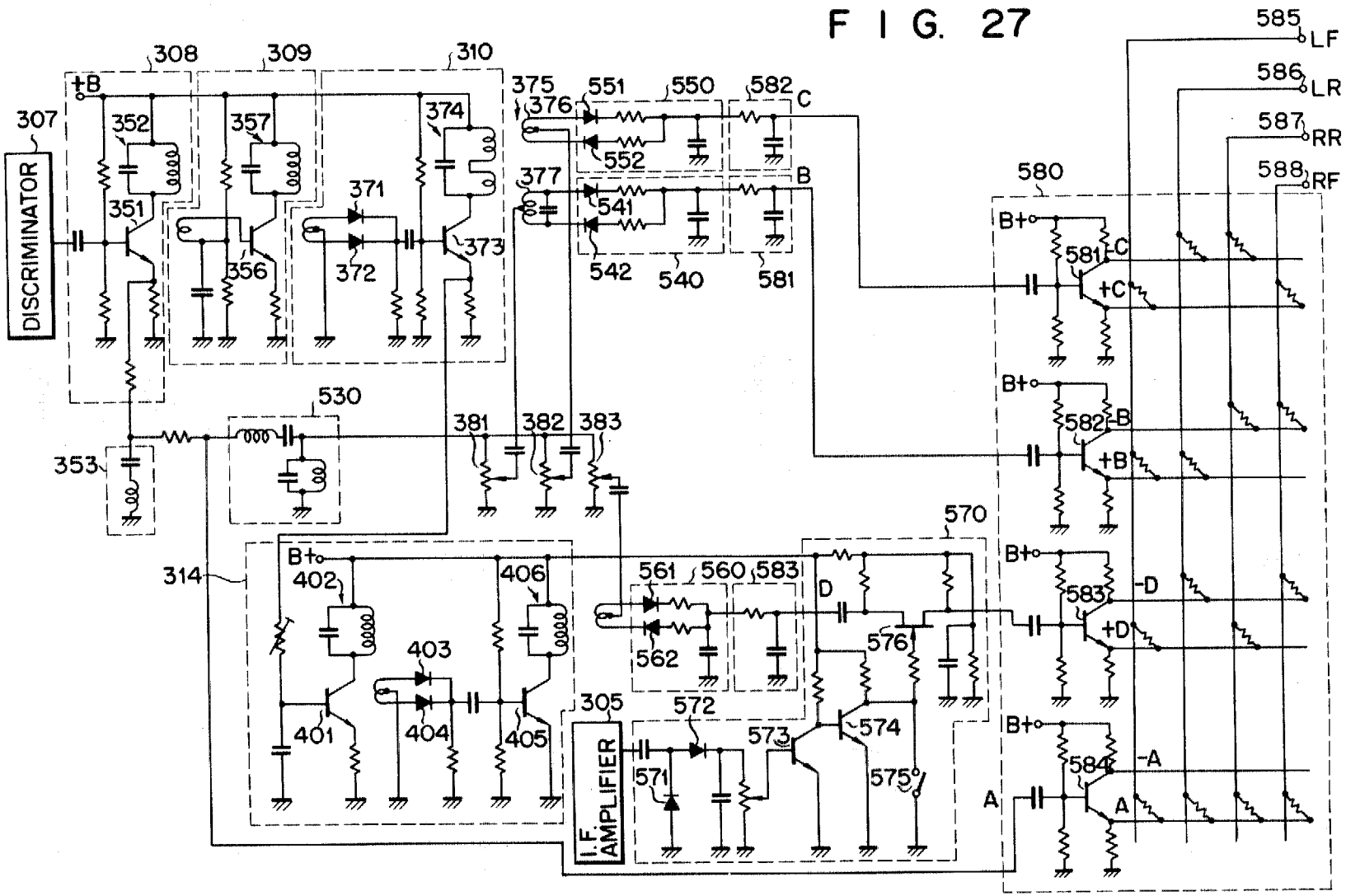
FIG. 27 is a detailed circuit diagram of the embodiment shown in FIG. 26.

FIGS. 26 and 27 illustrate a third embodiment of the present invention. The output of the discriminator 307 is connected to the doubler 310 through the 19 $KH_z$ bandpass filter 308 and the amplifier 309. The output of the doubler 310 is connected to the switching circuit 540 and further to the switching circuit 550 through a phase shifter 312 and to the switching circuit 560 through the doubler 314. The switching circuits 540, 550 and 560 are all connected to the discriminator 307 through a bandpass filter 530. The outputs of the switching circuits 540 and 550 are connected to the matrix circuit 580 through the deemphasis circuits 581 and 582. The output of the switching circuits 560 is connected to the matrix circuit through the deemphasis circuit 483 and the muting circuit 570 which is connected to the intermediate frequency amplifier 305.

In FIG. 27 the composite signal which is the output signal of the discriminator 307 is passed through the transistor 351, the trap circuit 353 and further through a bandpass filter 530 having a pass-band of about 23 $KH_z$ to 80 $KH_z$ to produce the composite signal having its A signal eliminated. This signal is then fed to the secondary coils 377 and 376 and the switching circuits 560 through the variable resistors 381, 382 and 383 for controlling the channel separation. The coil 377 has a first 38 $KH_z$ switching signal induced therein, and in response to this switching signal the switching circuit 540 comprising the diode 541 and 542 switches the composite signal with its A signal eliminated to produce the B signal through the deemphasis circuit 581. On the other hand, the coil 376 has a second 38 $KH_z$ switching signal induced therein which is 90° out of phase with response to the first switching signal. The switching circuit 550 comprising the diodes 551 and 552 switches the composite signal without the A signal in response to the switching signal to produce the C signal through the deemphasis circuit 582. The composite signal which lacks the A signal is also switched in the switching circuit 560 comprising the diode 561 and 562 in response to the 76 $KH_z$ switching signal fed from the doubler 314 to produce the D signal through the deemphasis circuit 583. The D signal is then supplied to the matrix circuit 580 through an FET 576 of the muting circuit 570, which comprises diodes 571 and 572, transistors 573 and 574, a manual switch 575 and the FET 576. When the output signal level of the intermediate frequency amplifier is sufficiently high, the transistor 573 is in its on condition, the transistor 574 is off so that the FET is in conductive state. When the output signal level of the intermediate frequency amplifier is low, the transistor 573 is off, the transistor 574 is on so that the FET 576 is in non-conductive state. When the manual switch 575 is closed the FET 576 is always held in non-conductive state.

The matrix circuit 580 includes transistors 581, 582, 583 and 584 to which the B, C and D signals obtained as stated above are fed and the composite signal including the A signal from the discriminator 307 is fed through the transistor 351 and the trap circuit 353. The output terminals 585, 586, 587 and 588 of the matrix circuit 580 are suitably connected through resistors to the collectors or emitters of the transistors 581, 582, 583 and 584 to produce the LF, LR, RR and RF signals which are produced by the matrix conversion represented by the previous formula (7). By the action of the muting circuit 570, when the D signal only is not supplied to the matrix circuit 580, the output terminals 585 to 587 provide the LF', LR', RR', and RF' signal as represented by the previous formulas (8).

Figure 28:
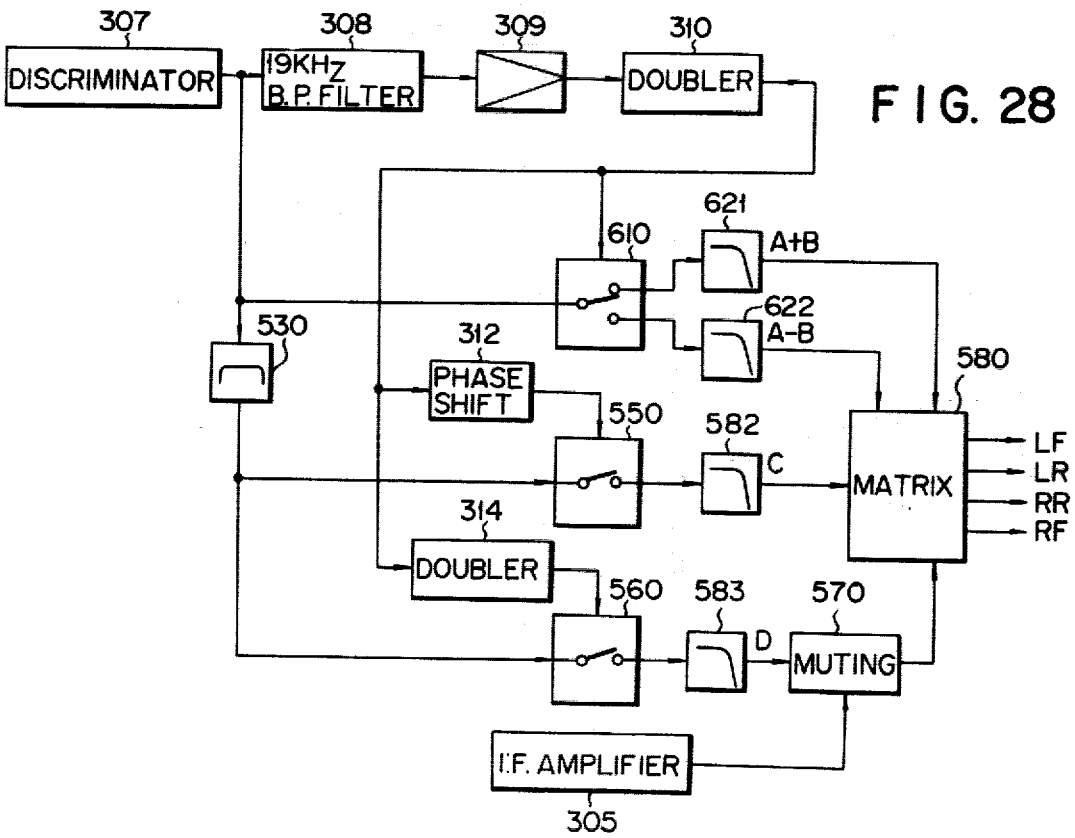
FIG. 28 is a block diagram illustrating a fourth embodiment of the receiver of the present invention.
Figure 29:
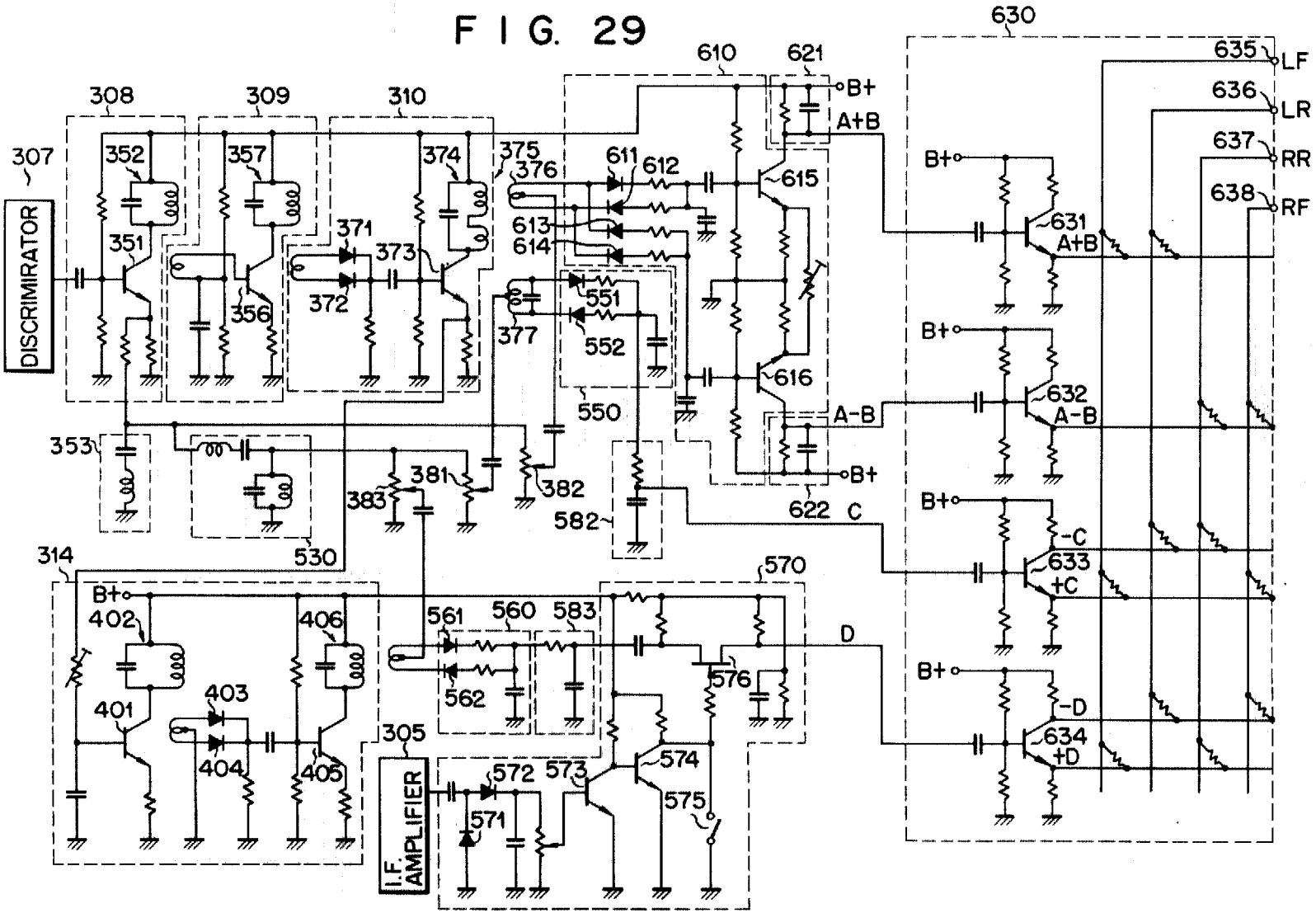
FIG. 29 is a detailed circuit diagram of the embodiment shown in FIG. 28.

FIGS. 28 and 29 illustrate a fourth embodiment of the decoder. The output of the discriminator 307 is connected to the doubler 310 through the 19 $KH_z$ band-pass filter 308 and the amplifier 309. The output of the doubler 310 is connected to the switching circuit 610 and further connected to the switching circuit 550 through the phase shifter 312 and to the switching circuit 560 through the doubler 314. The switching circuit 610 is connected to the outputs of the discriminator 307, which in turn is connected to the matrix circuit 630 through the deemphasis circuits 621 and 622. The switching circuits 550 and 560 are connected to the output of the discriminator 307 through a band-pass filter 530, the output of the switching circuit 550 is connected to the matrix 630 through the deemphasis circuit 582. The output of the switching circuit 560 is connected to the matrix 630 throught the deemphasis circuit 583 and the muting circuit 570 connected to the intermediate frequency amplifier 305.

In FIG. 29, the composite signal from the discriminator 307 is supplied through the transistor 351, the trap circuit 353 and the variable resistor 382 to the switching circuit 610. The secondary coil 376 of the transformer 375 has the first 38 $KH_z$ switching signal induced therein which is the output of the doubler 310. The switching circuit 610 comprising the diodes 611 to 614 and the transistors 615 and 616 switches the composite signal in response to the first 38 $KH_z$ switching signal to produce A+B signal and A−B signal through the deemphasis circuits 621 and 622, respectively. The composite signal, after being passed through a band-pass filter 530 having a pass-band of about 23 $KH_z$ to 80 $KH_z$ to eliminate the A signal, is supplied to the switching circuit 550 through the variable resistor 381 and also supplied to the switching circuit 560 through the variable resistor 383. The secondary coil 377 of the transformer 375 has the second 38 $KH_z$ switching signal induced therein which is 90° out of phase with respect to the first switching signal. The switching circuit 550 switches the composite signal which lacks the A signal in response to the second switching signal to produce the C signal through the deemphasis circuit 582. The switching circuit 560 switches the composite signal which lacks the A signal in response to the 76 $KH_z$ switching signal supplied from the doubler 314 to produce the D signal through the deemphasis circuit 583.

The matrix circuit 630 consists of the transistors 631 to 634 to which the A+B, A−B and C signal are directly fed and the D signal is fed through the muting circuit 570. The output terminals 635, 636, 637 and 638 are suitably connected through the resistors to the emitters or collectors of the transistors 631 to 634 to produce the LF,LR, RR, and RF signals by the matrix conversion represented by the previous formulas (7). By the action of the muting circuit 570, when the D signal is not supplied to the matrix circuit 630, the output terminals 635 to 638 produce the LF', LR', RR' and RF' signals as represented by the previous formulas (8).

What is claimed is:

1. A discrete four channel stereophonic broadcasting system comprising a transmitter including a source of four-channel stereophonically related audio frequency signals representing LF, LR, RF and RR respectively, means for producing a composite signal representing a modulation function of the form:

$$f_1(t) = A + B \sin 2\omega t + C \cos 2\omega t + D \sin 4\omega t + K \sin \omega t$$

where $A = LR + LR + RR + RF$,
$B = LF + LR - RR - RF$,
$C = LF - LR - RR + RF$,
$D = LF - LR + RR - RF$,
K is a constant, and
$\omega$ is an angular frequency higher than that of said audio signals, means for providing a main carrier wave, means for frequency modulating said main carrier wave in accordance with said composite signal, and means for broadcasting said frequency modulated main carrier wave.

2. The broadcasting system according to claim 1, said means for producing the composite signal of said transmitter comprising electrical matrix means for encoding audio frequency signals LF, LR, RF and RR to provide electrical signals A, B, C and D each representing the form:

$A = LF + LR + RR + RF,$
$B = LF + LR - RR - RF,$
$C = LF - LR - RR + RF,$
$D = LF - LR + RR - RF,$ means for providing a first subcarrier wave representing the form:

$$S_1(t) = V_1 \sin 2\omega t,$$

where $V_1$ is a constant, means for providing a second subcarrier wave representing the form:

$$S_2(t) = V_2 \sin (2\omega t + [\pi/2]) = V_1 \cos \omega t,$$

where $V_2$ is a constant, means for providing a third subcarrier wave representing the form:

$$S_3(t) = V_3 \sin 4\omega t,$$

where $V_3$ is a constant, means for supressed-subcarrier amplitude modulating said first subcarrier wave in accordance with said signal B, means for suppressed-subcarrier amplitude modulating said second subcarrier wave in accordance with said signal C, means for suppressed-subcarrier amplitude modulating said third subcarrier wave in accordance with said signal D means for producing a pilot signal representing the form:

$$P(t) = K \sin \omega t,$$

and means for electrically adding said signal A, said first subcarrier wave amplitude modulated with said signal B, said second subcarrier wave amplitude modulated with said signal C, said third subcarrier wave amplitude modulated with said D and said pilot signal.

3. The broadcasting system according to claim 1, said means for producing the composite signal of said transmitter comprising:

means for providing a first swiching signal having a frequency of $(2\omega)/\pi$, means for providing a second switching signal having a frequency of $\omega/\pi$, first switching means for switching the LF signal and the LR alternately in response to said first switching signal, second switching means for switching the RR signal and the RF alterantely in response to said first switching signal, third switching means for switching the output of said first switching means and the output of said second switching means alternately in response to said second switching signal to provide a switched signal successively representing waveforms extending from the LF level to the LR level, from the LR to RR, from the RR to the RF, and from the RF to the LF, means for providing a pilot signal representing the form:

$$P(t) = K \sin \omega t,$$

means for controlling channel separation having inputs of the LF signal, the LR, the RF aand the RR, adding means for electrically adding said switched signal, said pilot signal and the output of said channel separation controlling means, and low-pass filtering means coupled to the output of said adding means.

4. The broadcasting system according to claim 3 wherein said first, second and third switching means each comprise respective two-level switching means.

5. A discrete four channel stereophonic broadcasting system comprising a transmitter and at least one receiver, said transmitter having:

a source of four-channel stereophonically related audio frequency signals representing LF, LR, RF and RR respectively, means for producing a composite signal representing a modulation function of the form:

$$f_1(t) = A + B \sin 2\omega t + C \cos 2\omega t + D \sin 4\omega t + K \sin \omega t$$

where $A = LF + LR + RR + RF,$
$B = LF + LR - RR - RF,$
$C = LF - LR - RR + Rf,$
$D = LF - LR + RR - RF,$ K is a constant, and $\omega$ is an angular frequency higher than that of said audio signals, means for providing a main carrier wave, means for frequency modulating said main carrier wave in accordance with said composite signal, and means for broadcasting said frequency modulated main carrier wave, said receiver comprising:

means for receiving and demodulating the frequency modulated main carrier wave to provide said composite signal, and means for detecting said composite signal under the control of the pilot signal representing the function $K \sin \omega t$ defined as the fifth term of aforementioned equation to provide said audio frequency signals representing LF, LR, RF and RR respectively.

6. The broadcasting system according to claim 5, wherein said detecting means of said receiver comprises switching means for switching said composite signal under the control of said pilot signal to produce a plurality of signals, decoder means connected to receive output signals from said switching means to provide the LF audio signal, the LR, the RR and the RF including electrical matrix means for converting the A signal, the B, the C and the D into the LF signal, the LF, the RR and the RF, respectively defined as following equations:

$LF = A + B + C + D,$
$LR = A + B - C - D,$
$RR = A - B - C + D,$
$RF = A - B + C - D.$

7. The broadcasting system according to claim 6, wherein said detecting means of said receiver further comprises muting means for stopping application of the D signal to said matrix means in response to the level of the broadcasting frequency modulated wave which is received by said receiving means.

8. The broadcasting system according to claim 5, wherein said detecting means of said receiver comprises:

switching means for switching said composite signal under the output of said pilot signal to produce directly the LF audio signal, the LR, the RR and the RF.

9. The broadcasting system according to claim 5, wherein said receiver comprises:

means for detecting said composite signal under the control of said pilot signal to provide audio frequency signals representing LF', LR', RR', and RF' which are proportional to 3LF+LR−RR+RF, LF+3LR+RR−RF, −LF+LR+3RR+RF, and LF−LR+RR+3RF respectively.

10. A receiver apparatus for receiving waves frequency-modulated in accordance with a composite signal including a main channel signal A, a first suppressed subcarrier signal amplitude modulated by a first subchannel signal B, a second suppressed subcarrier signal amplitude-modulated by a second subchannel signal C, a third suppressed subcarrier signal amplitude-modulated by a third subchannel signal D, and a pilot signal having a predetermined frequency, said first and second subcarrier signals each having a frequency two times that of the pilot signal respectively and having a 90° phase difference therebetween, said third subcarrier signal having a frequency four times that of the pilot signal, and said main channel signal A and subchannel signals B, C and D being represented by LF+LR+RR+RF, LF+LR−RR−RF, LF−LR−RR+RF and LF−LR+RR−RF respectively, where, LF, LR, RR and RF are four-channel audio signals, said receiver apparatus comprising:

discriminating means for discriminating said composite signal from the frequency modulated waves;

means for producing a first switching signal having a frequency two times that of said pilot signal in response to said pilot signal included in said composite signal;

means for producing a second switching signal having a frequency equal to that of said first switching signal and having a 90° phase difference with respect to said first switching signal;

means for producing a third switching signal having a frequency two times that of said first switching signal;

first switching means coupled to the output of said discriminating means for producing output signals A+B and A−B in response to said first switching signals;

second switching means coupled to the output of said discriminating means for producing output signals A+C and A−C in response to said second switching signals;

third switching means coupled to the output of said discriminating means for producing output signals A+D and A−D in response to said third switching signal; and means connected to receive said output signals from said first to third switching means and including matrix means for obtaining four output signals corresponding to said audio signals LF, LR, RR and RF, respectively.

11. A receiver apparatus according to claim 10 wherein said last mentioned means for receiving the output signals from said first to third switching means includes:

first differential amplifier means coupled to the output of one of said first to third switching means for producing 180° out-of-phase subchannel signals; and second differential amplifier means coupled to the output of the other switching means for producing 180° out-of-phase subchannel signals.

12. A receiver apparatus according to claim 10 further including:

means responsive to the level of the received frequency-modulated waves for producing a control signal when the level of said received frequency-modulated waves is below a predetermined level; and means for stopping application of subchannel signal D to said matrix means in response to said control signal.

13. A receiver apparatus according to claim 12 wherein said last mentioned stopping means includes manually operable switch means for selectively stopping application of said subchannel signal D to said matrix means irrespective of the level of received frequency-modulated waves.

14. A receiver apparatus for receiving waves frequency-modulated in accordance with a composite signal including a main channel signal A, a first suppressed subcarrier signal amplitude-modulated by a first subchannel signal B, a second suppressed subcarrier signal amplitude-modulated by a second subchannel signal C, a third suppressed subcarrier signal amplitude-modulated by a third subchannel signal D, and a pilot signal having a predetermined frequency, said first and second subcarrier signals each having a frequency two times that of said pilot signal and having a 90° phase difference therebetween, said third subcarrier signal having a frequency four times that of said pilot signal, and said main channel signal A, and subchannel signals B, C and D being represented by LF+LR+RR+RF, LF+LR−RR−RF, LF−LR−RR+RF, and LF−LR+RR−RF respectively, where LF, LR, RR and RF are four channel audio signals, said receiver apparatus comprising:

discriminating means for discriminating said composite signal from the frequency-modulated waves;

means for producing a first switching signal having a frequency two times that of said pilot signal in response to said pilot signal included in said composite signal;

means for producing a second switching signal having a frequency two times that of said first switching signal;

first switching means coupled to the output of said discriminating means for producing first and second output signals in response to said first switching signal;

second switching means connected to receive said first output signal of said first switching means for producing two output signals corresponding to two of said four-channel audio signals respectively in response to said second switching signal; and third switching means connected to receive said second output signal of said first switching means for producing two output signals corresponding to the remaining two of said four-channel audio signal respectively in response to said second switching signal.

15. A receiver apparatus according to claim 14 further including:

means responsive to the level of the received frequency-modulated waves for producing a control signal when the level of said received frequency-modulated waves is below a predetermined level; and means connected between said discriminating means and said first switching means and responsive to said control signal for stopping application of said third suppressed subcarrier signal to said first switching means.

16. A receiver apparatus according to claim 15 wherein said last mentioned stopping means includes manually operable switch means for selectively stopping appllication of said third suppressed subcarrier signal to said first switching means irrespective of the level of received frequency-modulated waves.

17. A receiver apparatus for receiving waves frequency-modulated in accordance with a composite signal including a main channel signal A, a first suppressed subcarrier signal amplitude-modulated by a first subchannel signal B, a second suppressed subcarrier signal amplitude-modulated by a second subchannel signal C, a third suppressed subcarrier signal amplitude-modulated by a third subchannel signal D, and pilot signal having a predetermined frequency, said first and second subcarrier signals having a frequency two times that of said pilot signal and having a 90° phase difference therebetween, said third subcarrier signal having a frequency four times that of said pilot signal, and said main channel signal A and subchannel signals B, C and D being represented by LF+LR+RR+RF, LF+LR−RR−RF, LF−LR−RR+RF, and LF−LR+RR−RF, respectively where LF, LR, RR and RF are four channel audio signals, said receiver apparatus comprising:

discriminating means for discriminating said composite signal from the received frequency-modulated waves;

means for producing a first switching signal having a frequency two times that of said pilot signal in response to said pilot signal in said composite signal;

means for producing a second switching signal having a frequency equal to that of said first switching signal and having a 90° phase difference with respect to said first switching signal;

means for producing a third switching signal having a frequency two times that of said first switching signal;

filter means coupled to the output of said discriminating means for eliminating said main channel signal A from said composite signal;

first switching means coupled to the output of said filter means for producing said first subchannel signal B in response to said first switching signal;

second switching means coupled to the output of said filter means for producing said second subchannel signal C in response to said second switching signal;

third switching means coupled to the output of said filter means for producing said third subchannel signal D in response to said third switching signal; and matrix means connected to receive output signals B, C, and D from said first, second, and third switching means and signals including said main channel signal A from said discriminating means for obtaining four-channel output signals corresponding to said four-channel audio signals, respectively.

18. A receiver apparatus according to claim 17 further comprising:

means responsive to the level of the received frequency-modulated waves for producing a control signal when the level of said received frequency-modulated waves is below a predetermined level; and means for stopping application of subchannel signal D to said matrix means in response to said control signal.

19. A receiver apparatus according to claim 18 wherein said last mentioned stopping means includes manually operable switch means for selectively stopping application of said subchannel signal D to said matrix means irrespective of the level of received frequency-modulated waves.

20. A receiver apparatus for receiving waves frequency-modulated in accordance with a composite signal including a main channel signal A, a first suppressed subcarrier signal amplitude-modulated by a first subchannel signal B, a second suppressed subcarrier signal amplitude-modulated by a second subchannel signal C, a third suppressed subcarrier signal amplitude-modulated by a third subchannel signal D, and a pilot signal having a predetermined frequency, said first and second subcarrier signals each having a frequency two times that of said pilot signal respectively and having a 90° phase difference therebetween, said third subcarrier signal having a frequency four times that of said pilot signal, and said main channel signal A and subchannel signals B, C and D being represented by LF+LR+RR+RF, LF+LR−RR−RF, LF−LR−RR+RF and LF−LR+RR−RF, respectively, where LF, LR, RR and RF are four-channel audio signals, and receiver apparatus comprising:

discriminating means for discriminating said composite signal from the received frequency-modulated waves;

means for producing first, second and third switching signals which are harmonics waves of said pilot signal and correspond to said first, second and third subcarrier signals, respectively;

switching means coupled to the output of said discriminating means for producing sum and difference signals of said main channel signal and one of said subchannel signals, and two subchannel signals in response to said first, second and third switching signals; and matrix means connected to receive output signals of said switching means for obtaining four-channel audio output signals corresponding to said four-channel audio signals LF, LR, RR, RF, respectively.

21. A receiver apparatus according to claim 20 further comprising:

means responsive to the level of received frequency-modulated waves for producing a control signal when the level of the received frequency modulated wave is below a predetermined level; and means for stopping application of said subchannel signal D to said matrix means in response to said control signal.

22. A receiver apparatus according to claim 21 wherein said last mentioned stopping means includes manually operable switch means for selectively stopping said subchannel signal D to said matrix means irrespective of the level of received frequency-modulated waves.

23. A receiver apparatus for receiving waves frequency-modulated in accordance with a composite signal including at least a main channel signal A, a first suppressed subcarrier signal amplitude-modulated by a first subchannel signal B, a second suppressed subcarrier signal amplitude-modulated by a second subchannel signal C, and a pilot signal having a predetermined frequency, said first and second subcarrier signals each having a frequency two times that of said pilot signal and having a 90° phase difference therebetween, said main channel signal A, and subchannel signals B and C being represented by LF+LR+RR+RF, LF+LR−RR−RF, and LF−LR−RR+RF, respectively, where LF, LR, RR and RF are four-channel audio signals, said apparatus comprising:

discriminating means for discriminating signals including at least said main channel signal, first and second suppressed subcarrier amplitude-modulated signals and pilot signal;

means for producing switching signals which are harmonic waves of said pilot signal;

switching means coupled to the output of said discriminating means for producing a plurality of output signals in response to said switching signals; and matrix means connected to receive said output signals from said switching means for obtaining four-channel audio output signals LF', LR', RR' and RF' which mainly include the corresponding component of said four-channel audio signals LF, LR, RR and RF, respectively.

24. A receiver apparatus according to claim 23 wherein said matrix means includes means for producing audio output signals LF', LR', RR' and RF' which are proportional to 3LF+LR−RR+RF, LF+3LR+RR−RF, −LF+LR+3RR+RF and LF−LR+RR+3RF, respectively.

25. A receiver apparatus for receiving waves frequency-modulated in accordance with a composite signal including at least a main channel signal A, a first suppressed subcarrier signal amplitude-modulated by a first subchannel signal B, a second suppressed subcarrier signal amplitude-modulated by a second subchannel signal C, and pilot signal having a predetermined frequency, said first and second subcarrier signals each having a frequency two times that of the pilot signal and having a 90° phase difference therebetween, said main channel signal A, and subchannel signals B and C being represented by LF+LR+RR+RF, LF+LR−RR−RF, and LF−LR−RR+RF, respectively, where LF,LR,RR and RF are four-channel audio signals, said apparatus comprising:

discriminating means for producing a signal corresponding to said composite signal;

means for producing switching signals which are harmonic waves of said pilot signal; and demodulation means for receiving said composite signal and said switching signals for producing from said composite signal four-channel audio output signals LF', LR,' RF' and RR' which mainly include the corresponding component of said four-channel audio signals LF, LR, RF and RR respectively.

26. A receiver apparatus according to claim 25 wherein said demodulation means includes means for producing audio output signals LF', LR', RR' and RF' which are proportional to 3LF+LR−RR+RF, LF+3LR+RR−RF, −LF+LR+3RR+RF and LF−LR+RR+3RF, respectively.

* * * * *